US007450066B2

(12) United States Patent
Haskell

(10) Patent No.: US 7,450,066 B2
(45) Date of Patent: Nov. 11, 2008

(54) PHASED ARRAY ANTENNA SYSTEM WITH ADJUSTABLE ELECTRICAL TILT

(75) Inventor: Philip Edward Haskell, Gosport (GB)

(73) Assignee: Quintel Technology Limtied (GB)

( * ) Notice: Subject to any disclaimer, the term of this patent is extended or adjusted under 35 U.S.C. 154(b) by 96 days.

(21) Appl. No.: 10/553,308

(22) PCT Filed: May 10, 2004

(86) PCT No.: PCT/GB2004/002016

§ 371 (c)(1),
(2), (4) Date: Oct. 14, 2005

(87) PCT Pub. No.: WO2004/102739

PCT Pub. Date: Nov. 25, 2004

(65) Prior Publication Data

US 2006/0208944 A1 Sep. 21, 2006

(30) Foreign Application Priority Data

May 17, 2003 (GB) ..... 0311371.9
May 22, 2003 (GB) ..... 0311739.7

(51) Int. Cl.
*H01Q 3/00* (2006.01)
*H04M 1/00* (2006.01)
*H04B 1/00* (2006.01)

(52) U.S. Cl. ..... 342/368; 455/562.1; 455/63.4

(58) Field of Classification Search ..... 342/368
See application file for complete search history.

(56) References Cited

U.S. PATENT DOCUMENTS 2,041,600 A 5/1936 Friis (Continued)

FOREIGN PATENT DOCUMENTS

AU 38746/93 7/1993

(Continued)

OTHER PUBLICATIONS

Strickland, Peter "Microstrip Base Station Antennas for Cellular Communications", IEEE, pp. 166-171 (1991).

(Continued)

*Primary Examiner*—Thomas H Tarcza
*Assistant Examiner*—Harry Liu
(74) *Attorney, Agent, or Firm*—McDonnell Boehnen Hulbert & Berghoff LLP

(57) ABSTRACT

A phased array antenna system with adjustable electrical tilt includes an array (62) of antenna elements $\mathbf{62}_1$, to $\mathbf{62}_{10}$. It has a splitter (44) dividing a radio frequency (RF) carrier signal into two signals between which a phase shifter (46) introduces a variable phase shift. Further splitters (52) and (54) divide the relatively phase shifted signals into two sets of five signals. Four of each of the sets of five signals are vectorially combined in a network of 180 degree hybrid couplers $\mathbf{60}_1$, to $\mathbf{60}_4$. This provides vector sum and difference components which together with the fifth members of the sets are fed to respective fixed phase shifters (56, 58) and $64_1$, to $\mathbf{64}_{10}$. The phase shifters $\mathbf{64}_1$, to $\mathbf{64}_{10}$ provide signals which are appropriately phased for use as phased array drive signals for respective antenna elements $62_1$, to $62_{10}$. Adjustment of the single phase shift provided by the variable phase shifter (46) changes the angle of electrical tilt of the entire antenna array (62).

30 Claims, 16 Drawing Sheets

U.S. PATENT DOCUMENTS

| | | | | | |
|---|---|---|---|---|---|
| 2,239,775 | A | | 4/1941 | Bruce | |
| 2,245,660 | A | | 6/1941 | Feldman et al. | |
| 2,247,666 | A | | 7/1941 | Potter | |
| 2,961,620 | A | | 11/1960 | Sommers | |
| 3,277,481 | A | | 10/1966 | Robin et al. | |
| 3,522,558 | A | | 8/1970 | Stafford et al. | |
| 3,710,329 | A | | 1/1973 | Mailloux et al. | |
| 4,241,352 | A | | 12/1980 | Alspaugh et al. | |
| 4,249,181 | A | | 2/1981 | Lee | |
| 4,749,969 | A | * | 6/1988 | Boire et al. | 333/120 |
| 4,788,515 | A | | 11/1988 | Wong et al. | |
| 4,881,082 | A | | 11/1989 | Graziano | |
| 5,281,974 | A | | 1/1994 | Kuramoto et al. | |
| 5,410,321 | A | * | 4/1995 | Gordon et al. | 342/374 |
| 5,736,963 | A | | 4/1998 | Roederer et al. | |
| 5,818,385 | A | * | 10/1998 | Bartholomew | 342/372 |
| 5,969,572 | A | * | 10/1999 | Jeong et al. | 330/149 |
| 6,148,185 | A | * | 11/2000 | Maruyama et al. | 455/115.1 |
| 6,366,237 | B1 | | 4/2002 | Charles | |
| 6,441,700 | B2 | | 8/2002 | Xu | |
| 6,603,436 | B2 | * | 8/2003 | Heinz et al. | 343/757 |
| 7,013,183 | B1 | * | 3/2006 | Solomon | 700/11 |
| 7,098,859 | B2 | * | 8/2006 | Shimawaki et al. | 343/781 CA |
| 7,224,247 | B2 | * | 5/2007 | Dean | 333/161 |
| 2004/0209572 | A1 | * | 10/2004 | Thomas | 455/63.4 |
| 2005/0075139 | A1 | * | 4/2005 | Shapira | 455/562.1 |
| 2005/0101352 | A1 | * | 5/2005 | Logothetis et al. | 455/562.1 |
| 2006/0068848 | A1 | * | 3/2006 | Shapira et al. | 455/562.1 |
| 2007/0149250 | A1 | * | 6/2007 | Crozzoli et al. | 455/562.1 |

FOREIGN PATENT DOCUMENTS

| | | |
|---|---|---|
| AU | 664625 | 11/1995 |
| EP | 0 575 808 | 12/1993 |
| EP | 0 531 090 | 3/2000 |
| EP | 1 193 792 | 4/2002 |
| GB | 1 314 693 | 4/1973 |
| GB | 2 034 525 | 6/1980 |
| GB | 2 317 056 | 3/1998 |
| JP | 61-006901 | 1/1986 |
| JP | 61-172411 | 8/1986 |
| JP | 02-174302 | 7/1990 |
| JP | 04-320121 | 11/1992 |
| JP | 04-320122 | 11/1992 |
| JP | 05-37222 | 2/1993 |
| JP | 05-075340 | 3/1993 |
| JP | 05-121902 | 5/1993 |
| JP | 05-121915 | 5/1993 |
| JP | 140985 | 5/1994 |
| JP | 06-196927 | 7/1994 |
| JP | 06-260823 | 9/1994 |
| JP | 06-326501 | 11/1994 |
| JP | 2001-211025 | 8/2001 |
| WO | WO 89/07837 | 8/1989 |
| WO | WO 92/16061 | 9/1992 |
| WO | WO 93/15569 | 8/1993 |
| WO | WO 95/10862 | 4/1995 |
| WO | WO 01/29926 | 4/2001 |
| WO | WO 03/036756 | 5/2003 |

OTHER PUBLICATIONS

Bacon, "Variable Elevation Beam-Aerial Systems for 1 ½ Metres", Journal IEE, pp. 539-544 (1946).

Forster, et al. "A Conical Beam Ship Array Antenna with Infinitely Variable Control of the Elevation Angle", pp. 17-20 (1973).

Hansen, "Microwave Scanning Antennas" vol. 3 Array Systems, pp. 2-7 (1966).

Smith, textbook: "Circuits, Devices and Systems", A First Course in Electrical Engineering, 4th Ed., pp. 680-681 (1984).

Okuyama et al., "Base-Station Antenna Systems for Car and Handheld Cellular Phones", Mitsubishi Denki Giho, vol. 68, No. 12, pp. 23-26 (1994).

Sumitomo Technical Review, Sep. 1993.

Brochure, "Brown Boveri Phaser for the Horizontal Slewing of Curtain Antennas", Boveri & Cie AG, Mannheim, RFA Classif. n° 1601/242.

CEL-901 Cellular Antenna Controller User's Manual, issued on Apr. 2, 1992, in the name of CAL Corporation (1991).

* cited by examiner 120
122
0.707c1
(a2A-b3B)
0.5c1(a2A-b3B)
-(0.707a1e1A)
c1
c2
a1e1A
I1
I2
S
D
H
PS
0.707c2(a2A-b3B)
0.5c1(a2A-b3B)
+(0.707a1e1A)
e1
e2
e3
a1
a1A
a2
a3
Vector
A
a1e2A
0.707(a2A+b3B)
a2A
b3B
0.5(a2A+b3B)
-(0.707b1f3B)
0.5(a2A+b3B)
+(0.707b1f3B)
0.707(a2A-b3B)
a1e3A
Tilt
Phase
0.707(b2B-a3A)
b1f3B
0.5(b2B+a3A)
+(0.707a1e3A)
b2B
0.5(b2B+a3A)
-(0.707a1e3A)
a3A
b3
0.707(b2B+a3A)
b2
Vector
B
b1
b1B
f3
f2
f1
b1f2B
b1f2B
0.5d1(b2B-a3A)
+(0.707b1f1B)
0.707d2(b2B-a3A)
0.707d2(b2B-a3A)
d2
d1
0.707d1(b2B-a3A)
0.5d1(b2B-a3A)
-(0.707b1f1B)
b1f1B

PHASED ARRAY ANTENNA SYSTEM WITH ADJUSTABLE ELECTRICAL TILT

BACKGROUND OF THE INVENTION (1) Field of the Invention

The present invention relates to a phased array antenna system with adjustable electrical tilt. It is suitable for use in many areas of telecommunications but finds particular application in cellular mobile radio networks, commonly referred to as mobile telephone networks. More specifically, but without limitation, the antenna system of the invention may be used with second generation (2G) mobile telephone networks such as the GSM system, and third generation (3G) mobile telephone networks such as the Universal Mobile Telephone System (UMTS).

(2) Description of the Art

Operators of cellular mobile radio networks generally employ their own base-stations, each of which has at least one antenna. In a cellular mobile radio network, the antennas are a primary factor in defining a coverage area in which communication to the base station can take place. The coverage area is generally divided into a number of overlapping cells, each associated with a respective antenna and base station. The cells are also generally divided into sectors to increase the communications coverage.

The antenna of each sector is connected to a base station for radio communication with all of the mobile radios in that sector. Base stations are interconnected by other means of communication, usually point-to-point radio links or fixed land-lines, allowing mobile radios throughout the cell coverage area to communicate with each other as well as with the public telephone network outside the cellular mobile radio network.

Cellular mobile radio networks which use phased array antennas are known: such an antenna comprises an array (usually eight or more) individual antenna elements such as dipoles or patches. The antenna has a radiation pattern consisting of a main lobe and sidelobes. The centre of the main lobe is the antenna's direction of maximum sensitivity, i.e. the direction of its main radiation beam. It is a well known property of a phased array antenna that if signals received by antenna elements are delayed by a delay which varies linearly with distance from an edge of the array, then the antenna main radiation beam is steered towards the direction of increasing delay. The angle between main radiation beam centres corresponding to zero and non-zero variation in delay, i.e. the angle of steer, depends on the rate of change of delay with distance across the array.

Delay may be implemented equivalently by changing signal phase, hence the expression phased array. The main beam of the antenna pattern can therefore be altered by adjusting the phase relationship between signals fed to different antenna elements. This allows the beam to be steered to modify the coverage area of the antenna.

Operators of phased array antennas in cellular mobile radio networks have a requirement to adjust their antennas' vertical radiation pattern, i.e. the pattern's cross-section in the vertical plane. This is necessary to alter the vertical angle of the antenna's main beam, also known as the "tilt", in order to adjust the coverage area of the antenna. Such adjustment may be required, for example, to compensate for change in cellular network structure or number of base stations or antennas. Adjustment of antenna angle of tilt is known both mechanically and electrically, and both individually or in combination.

Antenna angle of tilt may be adjusted mechanically by moving antenna elements or their housing (radome): it is referred to as adjusting the angle of "mechanical tilt". As described earlier, antenna angle of tilt may be adjusted electrically by changing time delay or phase of signals fed to or received from each antenna array element (or group of elements) without physical movement: this is referred to as adjusting the angle of "electrical tilt". When used in a cellular mobile radio network, a phased array antenna's vertical radiation pattern (VRP) has a number of significant requirements:

1. high main lobe (or boresight) gain;
2. a first upper side lobe level sufficiently low to avoid interference to mobiles using a base station in a different cell or network;
3. a first lower side lobe level sufficiently high to allow communications in the immediate vicinity of the antenna.

These requirements are mutually conflicting: for example, increasing the boresight gain may increase the level of the side lobes. A first upper side lobe level, relative to the boresight level, of −18 dB has been found to provide a convenient compromise in overall system performance.

The effect of adjusting either the angle of mechanical tilt or the angle of electrical tilt is to reposition the boresight so that it points either above or below the horizontal plane, which changes the coverage area of the antenna.

It is desirable to be able to vary both the mechanical tilt and the electrical tilt of an antenna of a cellular radio base station: this allows maximum flexibility in optimisation of cell or sector coverage, since these forms of tilt have different effects on antenna ground coverage and also on other antennas in the station's immediate vicinity. Moreover, operational efficiency is improved if the angle of electrical tilt can be adjusted remotely from the antenna assembly. Whereas an antenna's angle of mechanical tilt may be adjusted by repositioning its radome, changing its angle of electrical tilt requires additional electronic circuitry which increases antenna cost and complexity. Moreover, if a single antenna is shared between a number of operators, it is preferable to provide an individual angle of electrical tilt for each operator.

The need for an individual angle of electrical tilt from a shared antenna has hitherto not been met and has resulted in compromises in system performance. Further reductions in system performance may also occur if the gain decreases as a consequence of the technique adopted to change the angle of electrical tilt.

R. C. Johnson, Antenna Engineers Handbook, 3rd Ed 1993, McGraw Hill, ISBN 0-07-032381-X, Ch 20, Figure 20-2 discloses a method for locally or remotely adjusting the angle of electrical tilt of a phased array antenna. In this method, a radio frequency (RF) transmitter carrier signal is fed to the antenna and distributed to the antenna's radiating elements. Each antenna element has a variable phase shifter associated with it so that signal phase can be adjusted as a function of distance across the antenna to vary the antenna's angle of electrical tilt. The distribution of power when not tilted is proportioned so as to set the side lobe level and boresight gain. Optimum control of the angle of tilt is obtained when the phase front is controlled for all angles of tilt so that the side lobe level is not increased over the tilt range. The angle of electrical tilt can be adjusted remotely, if required, by using a servo-mechanism to control the position of the phase shifters.

This prior art method antenna has a number of disadvantages. A variable phase shifter is required for every antenna element. The cost of the antenna is high due to the number of such phase shifters required. Cost may be reduced by using a single common delay device or phase shifter for a group of antenna elements instead of per element, but this increases the side lobe level. See for example published International Patent Application No. WO 03/036756 A2 and Japanese Patent Application No. JP20011211025 A.

Mechanical coupling of delay devices may be used to adjust delays, but it is difficult to do this correctly; moreover, mechanical links and gears result in non-optimum distribution of delays. The upper side lobe level increases when the antenna is tilted downwards, thus causing a potential source of interference to mobiles using other base stations. If the antenna is shared by a number of operators, the operators then have a common angle of electrical tilt instead of different angles which is preferable. Finally, if the antenna is used in a communications system having up-link and down-link at different frequencies (frequency division duplex system), the angle of electrical tilt in transmit mode is different from that in receive mode because of frequency dependence of properties of signal processing components.

International Patent Application Nos. PCT/GB2002/004166 and PCT/GB2002/004930 describe locally or remotely adjusting an antenna's angle of electrical tilt by means of a difference in phase between a pair of signal feeds connected to the antenna.

SUMMARY OF THE INVENTION

It is an object of the present invention to provide an alternative form of phased array antenna system.

The present invention provides a phased array antenna system with adjustable electrical tilt and comprising an array of antenna elements characterised in that the system incorporates:

a) a variable phase shifter for introducing a variable relative phase shift between first and second RF signals,
b) splitting apparatus for dividing the relatively phase shifted first and second signals into component signals, and
c) a signal combining network for forming vectorial combinations of the component signals to provide a respective drive signal for each individual antenna element with appropriate phasing relative to other drive signals such that the angle of electrical tilt of the array is adjustable in response to alteration of the variable relative phase shift introduced by the variable phase shifter.

The invention provides the advantage that it is possible to adjust electrical tilt for the whole array using only a single variable phase shifter, instead of one variable phase shifter per antenna element or group of antenna elements as in the prior art. If one or more additional phase shifters are used, an extended range of electrical tilt can be obtained.

The antenna system may have an odd number of antenna elements. The variable phase shifter may be a first variable phase shifter, the system including a second variable phase shifter arranged to phase shift a component signal which has been phase shifted by the first variable phase shifter, and the second variable phase shifter providing a further component signal output for the signal combining and phase shifting network either directly or via one or more splitter/variable phase shifter combinations.

The variable phase shifter may be one of a plurality of variable phase shifters, the signal phase shifting and combining network being arranged to produce antenna element drive signals from component signals some of which have passed through all the variable phase shifters and some of which have not.

The splitting apparatus may be arranged to divide a component signal into further component signals for input to the signal phase shifting and combining network. The signal phase shifting and combining network may employ phase shifters and hybrid couplers (hybrids) for phase shifting and vectorially combining the component signals. The hybrids may be 180 degree hybrids, also known as sum-and-difference hybrids. The hybrids may be constructed as ring hybrids each with circumference $(n+\frac{1}{2})\lambda$ and input and output ports separated by $\lambda/4$, where n is an integer and $\lambda$ is the wavelength of the RF signals in material of which each ring hybrid is constructed. The input and output ports of each hybrid are matched to the system impedance.

The hybrids for vectorially combining the component signals may be designed to convert input signals I1 and I2 into vector sums and differences other than (I1+I2) and (I1−I2).

The splitting apparatus, variable phase shifter, and the signal phase shifting and combining network may be co-located with the antenna array to form an antenna assembly, the assembly having a single RF input power feeder from a remote source. Alternatively, the splitting apparatus may incorporate first, second and third splitters, the first splitter being located with the variable phase shifter remotely from the second and third splitters, the second and third splitters, the signal phase shifting and combining network and the antenna array being co-located as an antenna assembly, and the assembly having dual RF input power feeders from a remote source at which the first splitter and variable phase shifter are located.

The variable phase shifter may be a first variable phase shifter connected in a transmit channel, the system including a second variable phase shifter connected in a receive channel: there may be similar transmit and receive channels providing fixed phase shifts instead of variable phase shift: the signal phase shifting and combining network is then arranged to operate in both transmit and receive modes by producing antenna element drive signals in response to signals in the transmit channels and producing a receive channel signal from signals developed by antenna elements operating in receive mode. The angle of electrical tilt is then independently adjustable in each mode.

The variable phase shifter may be one of a plurality of variable phase shifters associated with respective operators, and the system includes filtering and combining apparatus for routing signals on to common signal feed apparatus after phase shifting in respective variable phase shifters, the common signal feed apparatus being connected to splitting apparatus and a signal combining and phase shifting network for providing signals to the antenna containing contributions from both operators with independently adjustable electrical tilt. The plurality of variable phase shifters may comprise a respective pair of variable phase shifters associated with each operator, and the system may have components which have both forward and reverse signal processing capabilities such that the system is operative in transmit and receive modes with independently adjustable electrical tilt in each mode.

In another aspect, the present invention provides a method of adjusting the electrical tilt of a phased array antenna system, the system including an array of antenna elements, characterised in that the method incorporates:

a) introducing a variable relative phase shift between first and second RF signals,
b) dividing the relatively phase shifted first and second signals into component signals, and
c) vectorially combining and relatively phase shifting the component signals to provide to provide a respective drive signal for each individual antenna element with appropriate phasing relative to other drive signals such that the angle of electrical tilt of the array is adjustable in response to alteration of the variable relative phase shift.

The array may have an odd number of antenna elements.

The method may include generating at least one component signal which has undergone phase shifting in a plurality of variable phase shifters. The variable phase shifters may be ganged, the method including producing antenna element drive signals from component signals some of which have passed through all the variable phase shifters and some of which have not.

The method may include dividing a component signal into further component signals for input to the signal phase shifting and combining network. It may employ phase shifters and hybrids for phase shifting and vectorially combining the component signals. The hybrids may be 180 degree hybrids. They may be ring hybrids with circumference $(n+\frac{1}{2})\lambda$ and input and output ports separated by $\lambda/4$, where n is an integer and $\lambda$ is the wavelength of the RF signals in material of which each ring hybrid is constructed. The splitting apparatus may also incorporate such ring hybrids, one port of each hybrid being terminated in a resistor equal in value to the system impedance to form a matched load.

The hybrids for vectorially combining the component signals may be designed to convert input signals I1 and I2 into vector sums and differences other than (I1+I2) and (I1−I2).

The method may include feeding a single RF input signal from a remote source for splitting, variable phase shifting and vectorial combining in a network co-located with the antenna array to form an antenna assembly. It may alternatively include feeding two RF input signals with variable phase relative to one another from a remote source to an antenna assembly and splitting, phase shifting and combining signals in a network co-located with the antenna array. It may employ transmit and receive channels for operation in both transmit and receive modes, producing antenna element drive signals in response to a signal in the transmit channels and producing a receive channel signal from signals developed by antenna elements operating in receive mode.

The variable phase shifter may be one of a plurality of variable phase shifters associated with respective operators, and the method may include:

a) filtering and combining signals and passing them to common signal feed apparatus after phase shifting in respective variable phase shifters, the common signal feed apparatus being connected to the splitting apparatus and the signal combining and phase shifting network;
b) providing signals to the antenna containing contributions from both operators; and
c) independently adjusting electrical tilt associated with each operator.

The plurality of variable phase shifters may comprise a respective pair of variable phase shifters associated with each operator; the method may employ components which have both forward and reverse signal processing capabilities, and the method may include operating in transmit and receive modes with independently adjustable electrical tilt in each mode.

DESCRIPTION OF THE FIGURES

In order that the invention might be more fully understood, embodiments thereof will now be described, by way of example only, with reference to the accompanying drawings, in which:—

DETAILED DESCRIPTION OF THE INVENTION

All examples illustrated employ connections for which source impedances of signals are equal to respective load impedances in order to form a 'matched' system. A matched system maximises the power transmitted from a source to a load and avoids signal reflections. Where signal lines are terminated in a resistor (see e.g. FIG. 6) the value of the resistor is equal to the system impedance in order to form a matched termination.

Figure 1A:
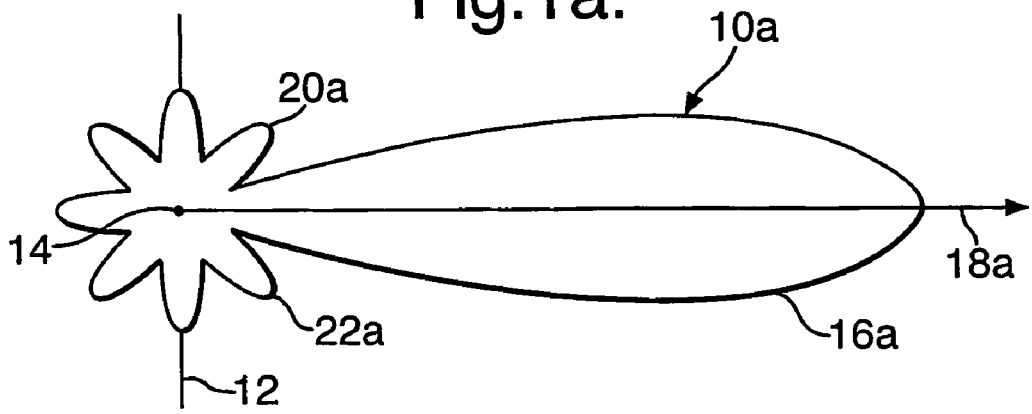
FIG. 1 shows a vertical radiation pattern (VRP) of a phased array antenna with zero and non-zero angles of electrical tilt.
Figure 1B:
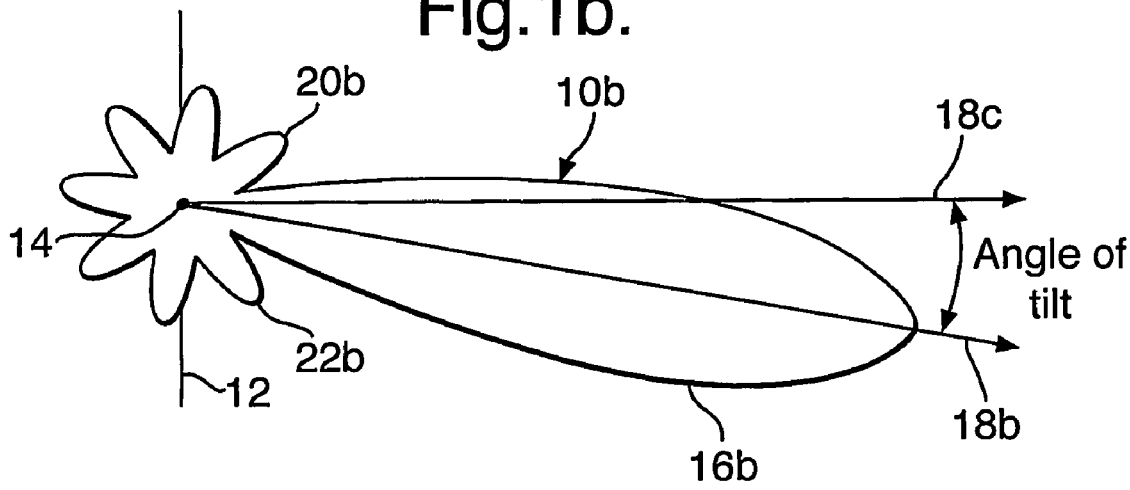

Referring to FIG. 1, there are shown vertical radiation patterns (VRP) 10*a* and 10*b* of an antenna 12 which is a phased array of individual antenna elements (not shown). The antenna 12 is planar, has a centre 14 and extends vertically in the plane of the drawing. The VRPs 10*a* and 10*b* correspond respectively to zero and non-zero variation in delay or phase of antenna element signals with distance across the antenna 12. They have respective main lobes 16*a*, 16*b* with centre lines or "boresights" 18*a*, 18*b*, first upper sidelobes 20*a*, 20*b* and first lower sidelobes 22*a*, 22*b*; 18*c* indicates the boresight direction for zero variation in delay for comparison with the non-zero equivalent 18*b*. When referred to without the suffix a or b, e.g. sidelobe 20, either of the relevant pair of elements is being referred to without distinction. The VRP 10*b* is tilted (downwards as illustrated) relative to VRP 10*a*, i.e. there is an angle—the angle of tilt—between main beam centre lines 18*b* and 18*c* which has a magnitude dependent on the rate at which delay varies with distance across the antenna 12.

The VRP has to satisfy a number of criteria: a) high boresight gain; b) the first upper side lobe 20 should be at a level low enough to avoid causing interference to mobiles using another cell and c) the first lower side lobe 22 should be sufficient for communications to be possible in the antenna's immediately vicinity.

The requirements are mutually conflicting: for example, maximising boresight gain may increase side lobes 20, 22. Relative to a boresight level (length of main beam 16), a first upper side lobe level of −18 dB has been found to provide a convenient compromise in overall system performance. Boresight gain decreases in proportion to the cosine of the angle of tilt due to reduction in the antenna's effective aperture. Further reductions in boresight gain may result depending on how the angle of tilt is changed.

The effect of adjusting either the angle of mechanical tilt or the angle of electrical tilt is to reposition the boresight so that it points either above or below the horizontal plane, and hence increases or decreases the coverage area of the antenna. For maximum flexibility of use, a cellular radio base station preferably has available both mechanical tilt and electrical tilt since each has a different effect on the shape and area of ground coverage and also on other antennas both in the immediate vicinity and in neighbouring cells. It is also convenient if an antenna's electrical tilt can be adjusted remotely from the antenna. Furthermore, if a single antenna is shared between a number of operators it is preferable to provide an individual angle of electrical tilt for each operator.

Figure 2:
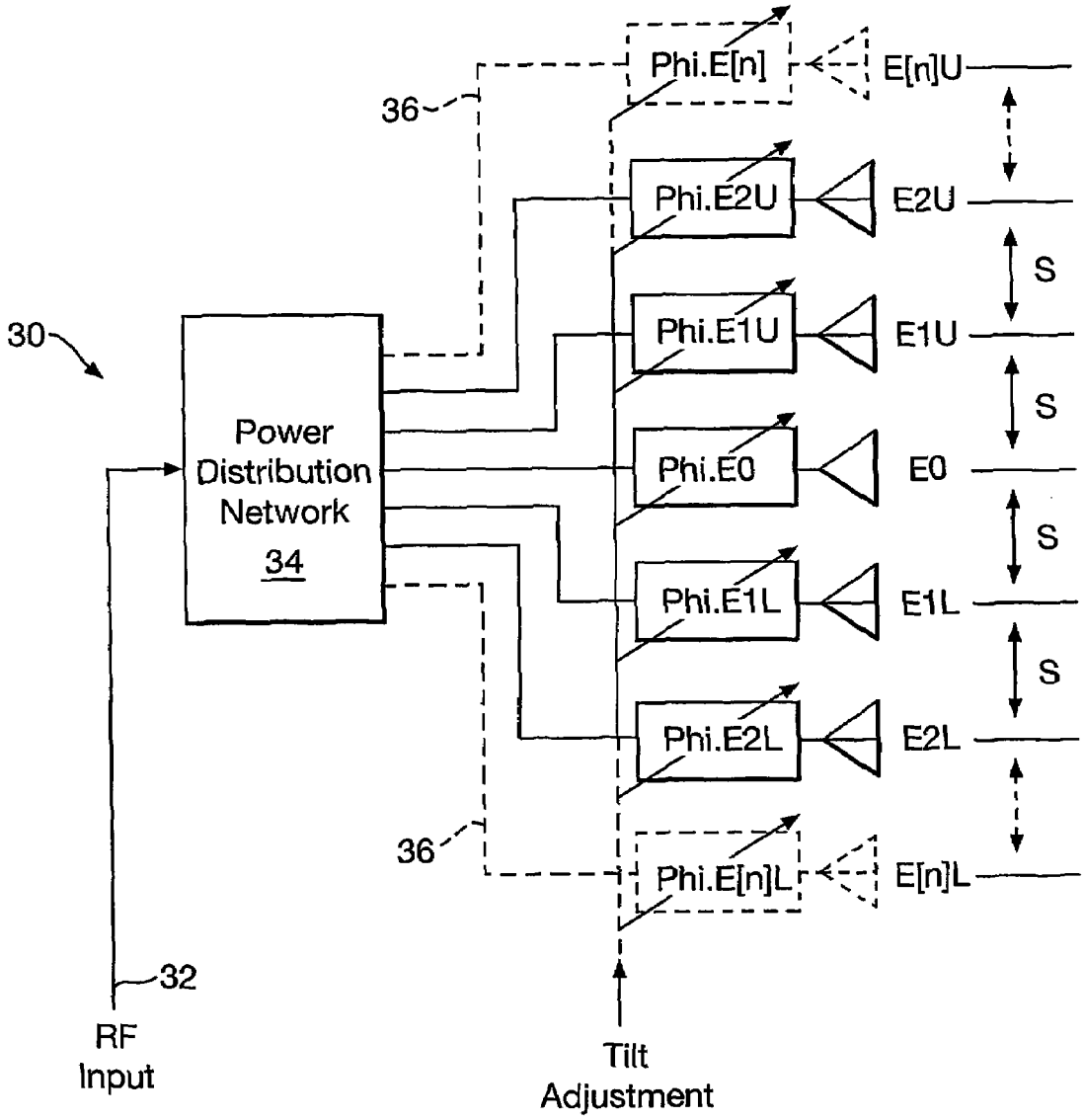
Fig.2. (Prior Art)
FIG. 2 illustrates a prior art phased array antenna having an adjustable angle of electrical tilt.

Referring now to FIG. 2, a prior art phased array antenna system 30 is shown in which the angle of electrical tilt is adjustable. The system 30 incorporates an input 32 for a radio frequency (RF) transmitter carrier signal, the input being connected to a power distribution network 34. The network 34 is connected via phase shifters Phi.E0, Phi.E1L to Phi.E[n]L and Phi.E1U to Phi.E[n]U to respective radiating antenna elements E0, E1L to E[n]L and E1U to E[n]U respectively of the phased array antenna system 30: here suffixes U and L indicate upper and lower respectively, n is an arbitrary positive integer greater than 2 which defines phased array size, and dotted lines such as 36 indicating the relevant element may be replicated as required for any desired array size.

Figure 3:
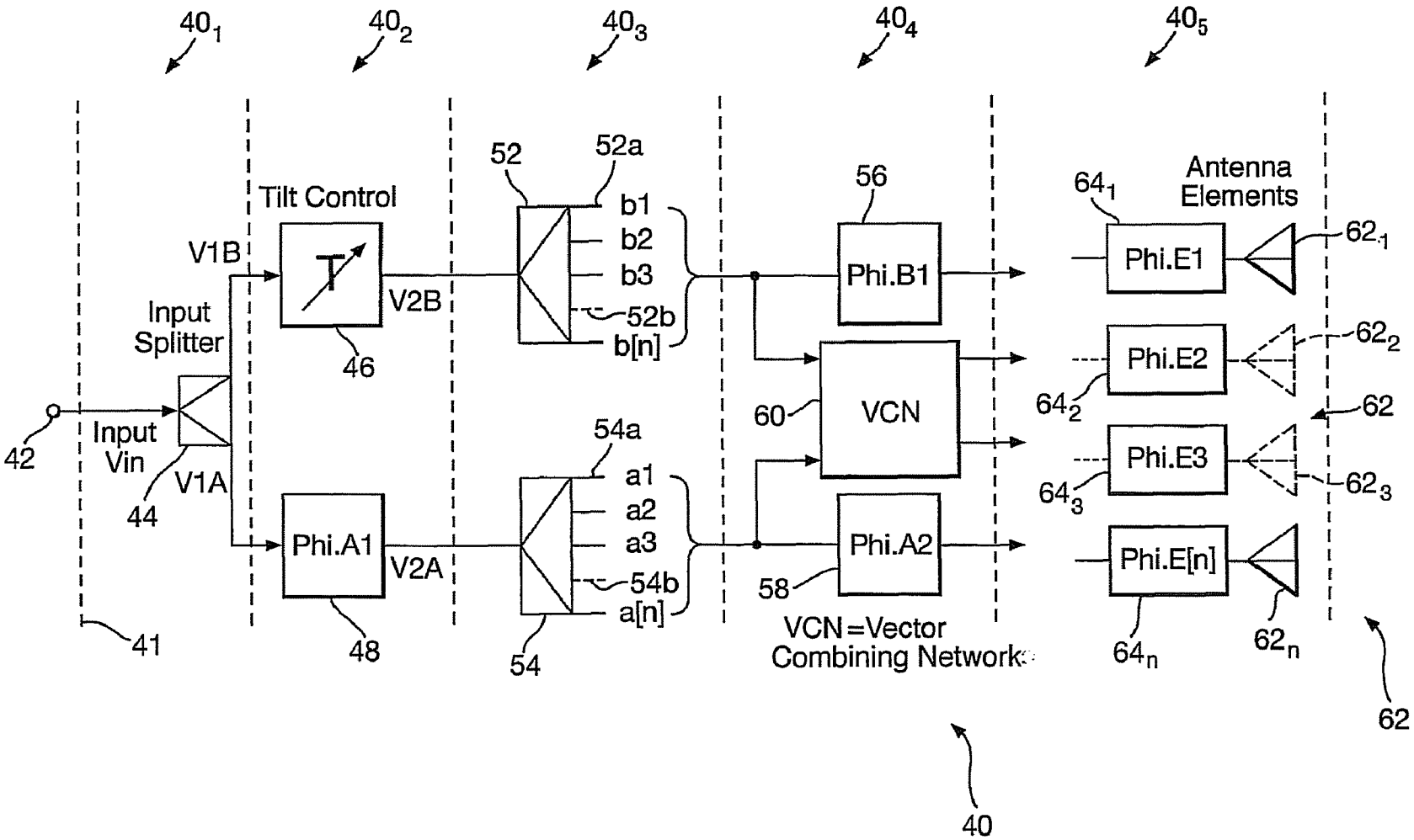
FIG. 3 is a block diagram of a phased array antenna system of the invention.

The phased array antenna system 30 operates as follows. An RF transmitter carrier signal is fed via the input 32 to the power distribution network 34: the network 34 divides this signal (not necessarily equally) between the phase shifters Phi.E0, Phi.E1L to Phi.E[n]L and Phi.E1U to Phi.E[n]U, which phase shift the signals they receive and pass on the resulting phase shifted signals to respective associated antenna elements E0, E1L to E[n]L, E1U to E[n]U. The phase shifts and signal amplitudes to each element are chosen to select an appropriate angle of electrical tilt. The distribution of power by the network 34 when the angle of tilt is zero is chosen to set the side lobe level and boresight gain appropriately. Optimum control of the angle of tilt is obtained when the phase front is controlled for all angles of tilt so that the side lobe level is not increased significantly over the tilt range. The angle of electrical tilt can be adjusted remotely, if required, by using a servo-mechanism to control the phase shifters Phi.E0, Phi.E1L to Phi.E[n]L and Phi.E1U to Phi.E[n]U, which may be mechanically actuated. The prior art phased array antenna system 30 has a number of disadvantages as follows:

a) a respective phase shifter is required for each antenna element, or per group of elements;

b) the cost of the antenna is high due to the number of phase shifters required;

c) cost reduction by applying phase shifters to groups of elements increases the side lobe level;

d) mechanical coupling of the phase shifters to set delays correctly is difficult and mechanical links and gears are used which result in a non-optimum delay scheme;

e) the upper side lobe level increases when the antenna is tilted downwards causing a potential source of interference to mobiles using other cells;

f) if an antenna is shared by different operators, all must use the same angle of electrical tilt;

g) in a system with up-link and down-link at different frequencies (frequency division duplex system), the angle of electrical tilt in transmit is different from that in receive;

Referring now to FIG. 3, a phased array antenna system 40 of the invention is shown which has an adjustable angle of electrical tilt. The system 40 incorporates five successive functional regions $\mathbf{40}_1$ to $\mathbf{40}_5$ referred to in the art as "levels" and indicated between pairs of dotted lines such as 41. It has an input 42 for an RF carrier transmission signal: the input 42 is connected as input to a power splitter 44 providing two output signals having amplitudes V1A, V1B, these becoming input signals to a variable phase shifter 46 and a first fixed phase shifter 48 respectively. The phase shifters 46 and 48 may equivalently be considered as time delays. They provide respective output signals V2B and V2A to two power splitters 52 and 54 respectively. The power splitters 52 and 54 have n outputs such as 52*a* and 54*a* respectively: here n is a positive integer equal to 2 or more, and dotted outputs 52*b* and 54*b* indicate the output in each case may be replicated as required for any desired phased array size.

The power splitter outputs such as 52*a* and 54*a* provide output signals having amplitudes Va1 to Va[n] and Vb1 to Vb[n] respectively (illustrated without the letter V). As will be described later in more detail, some of these output signals may have amplitudes equal to others and some unequal. In one embodiment (to be described) having ten antenna elements (n=5), Va1=Va2=Va3, Vb3=Vb4=Vb5; Va4=Vb2 and Va5=Vb1. These output signals are fed to the phase shifting and combining level $\mathbf{40}_4$, which contains second and third fixed phase shifters 56 and 58 and vector combining networks indicated collectively by 60. The level $\mathbf{40}_4$ will be described in more detail later: it provides drive signals to equispaced antenna elements $\mathbf{62}_1$ to $\mathbf{62}_n$ of a phased array 62 via respective fixed phase shifters $\mathbf{64}_1$ to $\mathbf{64}_n$. Here as before n is an arbitrary positive integer equal to or greater than 2 but equal to the value of n for the power splitters 52 and 54, and phased array size is 2n antenna elements. Inner antenna elements $\mathbf{62}_2$ and $\mathbf{62}_3$ are shown dotted to indicate they may be replicated as required for any desired phased array size.

The phased array antenna system 40 operates as follows. An RF transmitter carrier signal is fed (single feeder) via the input 42 to the power splitter 44 where it is divided into signals V1A and V1B (of equal power in this example). The signals V1A and V1B are fed to the variable and fixed phase shifters 46 and 48 respectively. The variable phase shifter 46 applies an operator-selectable phase shift or time delay, and the degree of phase shift applied here controls the angle of electrical tilt of the entire phased array 62 of antenna elements $\mathbf{62}_1$ etc. The fixed phase shifter 48 is not essential but convenient: it applies a fixed phase shift which for convenience is chosen to be half the maximum phase shift $\phi_M$ applicable by the variable phase shifter 46. This allows V1A to be variable in phase in the range $-\phi_M/2$ to $+\phi_M/2$ relative to V1B, and these signals after phase shift become V2B and V2A as has been said after output from the phase shifters 46 and 48.

Each of the power splitters 52 and 54 divides signals V2B or V2A into a respective set of n output signals Vb1 to Vb[n] or Va1 to Va[n], where the power of each signal in each set Vb1 etc. or Va1 etc. is not necessarily equal to the powers of the other signals in its set. The variation of signal powers across the sets Va1 etc. and Vb1 etc. is different for different numbers of antenna elements $\mathbf{62}_1$ etc. in the array 62.

One of the set of output signals Vb1 to Vb[n] is fed to a respective fixed antenna phase shifter $\mathbf{64}_3$ via the second phase shifter 56, and one of the set of output signals Va1 to Va[n] is likewise fed to another antenna phase shifter $\mathbf{64}_8$ via the third phase shifter 58. The second and third phase shifters 56 and 58 introduce padding phase shifts to compensate for that introduced by the combining networks 60. Other signals in the sets Vb1 to Vb[n] and Va1 to Va[n] are combined in pairs in the networks 60 to produce vectorially added resultant signals for driving respective antenna elements $\mathbf{62}_1$ etc via phase shifters $\mathbf{64}_1$ etc. The fixed phase shifters $\mathbf{64}_1$ etc. impose fixed phase shifts which vary between different antenna elements $\mathbf{62}_1$ etc. according to element geometrical position across the array 62: this sets a zero reference direction (18*a* or 18*b* in FIG. 1) for the array 62 boresight when zero phase difference between the signals V1A and V1B imposed by the variable phase shifter 46. The antenna phase shifters $\mathbf{64}_1$ etc. are not essential, but they are preferred because they can be used to a) proportion correctly the phase shift introduced by the tilt process, b) optimise suppression of the side lobes over the tilt range, and c) introduce an optional fixed angle of electrical tilt.

The angle of electrical tilt of the array 60 is variable simply by using one variable phase shifter, the variable phase shifter 46. This compares with the prior art requirement to have multiple variable phase shifters, one for every antenna element or sub-group of antenna elements. When the phase difference introduced by the variable phase shifter 46 is positive relative to the fixed phase shift 48 the antenna tilts in one direction, and when that phase difference is negative the antenna tilts in the opposite direction.

If there are a number of users, each user may have a respective phased array antenna system 40. Alternatively, if it is required that users share a common antenna, while retaining an individual electrical tilt capability, then each user may have a respective set of levels $\mathbf{40}_1$ and $\mathbf{40}_2$ in FIG. 3. In addition, a combining network consisting of levels $\mathbf{40}_3$, $\mathbf{40}_4$ and $\mathbf{40}_5$ is required to combine signals from the resulting plurality of sets of splitters 44 and phase shifters or delays 46 and 48 for feeding to the antenna array 62. Published International Patent Application No. WO 03/043127 A3 describes sharing in this way, but it uses an antenna with multiple sub-groups of antenna elements, each antenna element in a sub-group having the same element drive signal phase. In the antenna system 40, the antenna elements $\mathbf{62}_1$ to $\mathbf{62}_n$ all have different element drive signal phases as required for improved phased array performance.

It can be shown that the antenna system 40 has good side lobe suppression that is maintained over its electrical tilt range. The antenna system 40 can be implemented at lower cost than contemporary designs offering a similar level of performance. Its electrical tilt may be adjusted remotely using a single variable delay device, and this permits different operators to share it while providing each operator with an individual angle of electrical tilt. The angle of electrical tilt in transmit mode may either be the same, or different from that in receive mode by modifying the antenna system 40 to include different paths and phase shifters for transmit and receive as will be described later.

Figure 4:
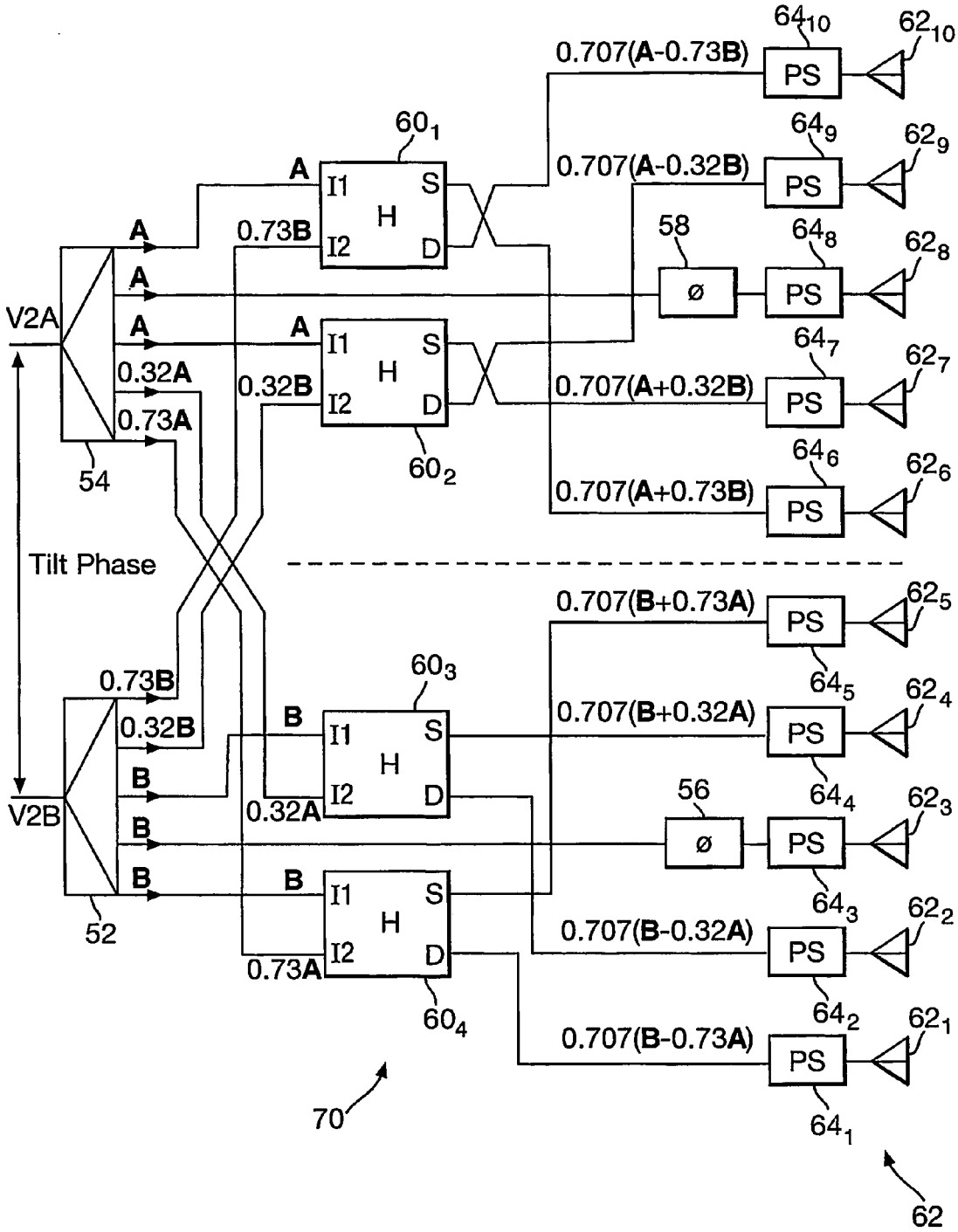
FIG. 4 shows in more detail a signal combining network used in the FIG. 3 system.

Referring now to FIG. 4, there is shown part of an implementation 70 of the invention for a phased array 62 of ten elements $\mathbf{62}_1$ to $\mathbf{62}_{10}$. Parts equivalent to those previously described are like referenced. FIG. 4 corresponds to parts $\mathbf{40}_3$ to $\mathbf{40}_5$ of FIG. 3, and splitters 52 and 54 are shown exchanged in position. The splitters 52 and 54 receive respectively input signals V2B and V2A of equal power but variable relative phase. They each split their respective inputs into five signals, three of which are of the same amplitude (A or B), and the other two are 0.32 and 0.73 of that amplitude (0.32 or 0.73 of A or B).

Eight of the ten signals from the splitters 52 and 54 pass to four vector combining devices $\mathbf{60}_1$ to $\mathbf{60}_4$: each of these devices is a 180 degree hybrid (marked H) having two input terminals designated I1 and I2 and two output terminals designated S and D for sum and difference respectively. The references I1 and I2 will also be used for convenience to indicate signals at those terminals. As indicated by the terminal designations, on receipt of input signals I1 and I2, each of the hybrids $\mathbf{60}_1$ to $\mathbf{60}_4$ produces two output signals at S and D which are the vector sum and difference of its respective input signals. Table 1 below shows the input signal amplitudes received by the hybrids $\mathbf{60}_1$ to $60_4$ and the output signals in vector form generated in response, expressed in terms of arbitrary values A and B in each case.

TABLE 1

| Hybrid | I1 Input | I2 Input | S Output | D Output |
|---|---|---|---|---|
| $60_1$ | A | 0.73B | 0.707(A + 0.73B) | 0.707(A − 0.73B) |
| $60_2$ | A | 0.32B | 0.707(A + 0.32B) | 0.707(A − 0.32B) |
| $60_3$ | B | 0.32A | 0.707(B + 0.32A) | 0.707(B − 0.32A) |
| $60_4$ | B | 0.73A | 0.707(B + 0.73A) | 0.707(B − 0.73A) |

Table 2 below shows the antenna elements which receive the output signals generated by the splitters 52 and 54 and hybrids $\mathbf{60}_1$ to $60_4$ via antenna phase shifters (PS) $\mathbf{64}_1$ to $64_{10}$.

TABLE 2

| Antenna Element | Signal Amplitude |
|---|---|
| $62_1$ | 0.707(B − 0.73A) |
| $62_2$ | 0.707(B − 0.32A) |
| $62_3$ | B |
| $62_4$ | 0.707(B + 0.32A) |
| $62_5$ | 0.707(B + 0.73A) |
| $62_6$ | 0.707(A + 0.73B) |
| $62_7$ | 0.707(A + 0.32B) |
| $62_8$ | A |
| $62_9$ | 0.707(A − 0.32B) |
| $62_{10}$ | 0.707(A − 0.73B) |

One signal A or B from each splitter 52 or 54 is not routed to antenna phase shifter $\mathbf{64}_3$ or $\mathbf{64}_8$ via a hybrid but instead via a phase shifter 56 or 58 applying a phase shift of $\phi$, which is equal to and compensates for that imposed by one of the hybrids $\mathbf{60}_1$ to $\mathbf{60}_4$. This is known as "padding". The fixed phase shifter pairs $\mathbf{56}/\mathbf{64}_3$ and $\mathbf{58}/\mathbf{64}_8$ could each be implemented as a single phase shift. The input splitter 44 in FIG. 3 may (optionally) provide unequal power splitting so that the signal amplitudes V2A and V2B are different in FIGS. 3 and 4. Furthermore, the hybrids $\mathbf{60}_1$ to $\mathbf{60}_4$ that (as described) provide sum and difference vectors I1+I2 and I1−I2 may (optionally) subsume all or part of the function of splitters 52 and 54: i.e. they may instead be designed to convert inputs I1 and I2 into vector sums and differences other than I1+I2 and I1−I2, for example a sum of xI1+yI2 where x and y are numerical values which are not equal. This is subject to the constraint that total output power plus hybrid losses must remain equal to total power input to the hybrids $\mathbf{60}_1$ to $\mathbf{60}_4$.

Moreover, instead of 180 degree hybrids $\mathbf{60}_1$ to $\mathbf{60}_4$, hybrids giving other phase shifts (e.g. 60 degrees, 90 degrees or 120 degrees) may be used.

Figure 5:
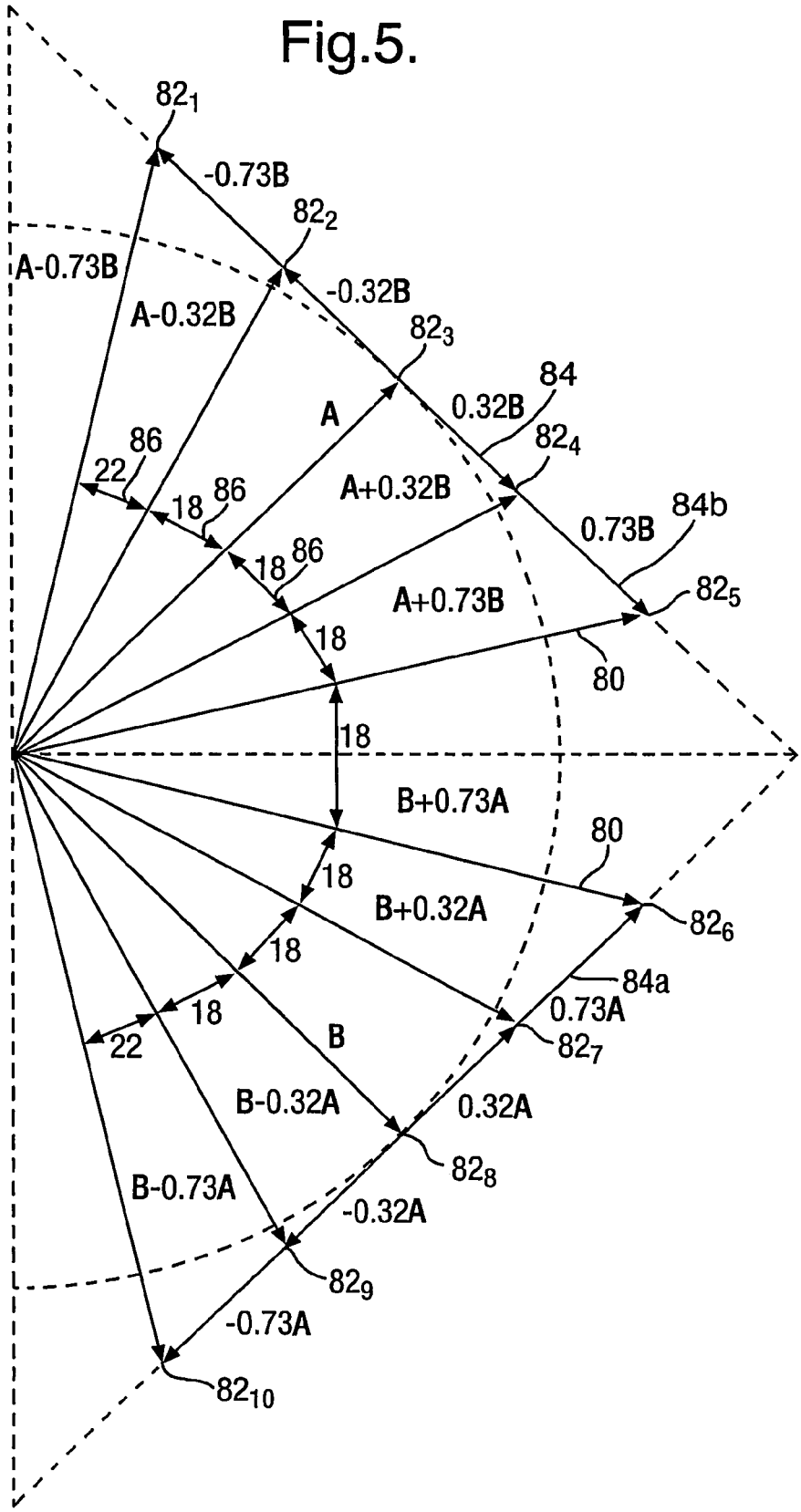
FIG. 5 is a phase diagram of antenna element signals associated with a ninety degree phase shift introduced by a variable phase shifter in the FIG. 3 system.

Referring now also to FIG. 5, there is shown a vector diagram for the antenna system 70 when the phase difference between signals V2A and V2B (having the same phase as A and B respectively) is 90 degrees, which is the angle, in this example, at which the phase front across the antenna elements is optimised. All vector sums and differences in FIG. 5 (i.e. all vectors other than A and B) should in fact be multiplied by $2^{-1/2}$ or 0.707 as in Tables 1 and 2, e.g. A+0.73B should be 0.707(A+0.73B); but this multiplicative constant is merely a scaling factor and has been omitted from the drawing to reduce complexity.

The antenna system 70 is optimised by determining the values of A and B in Tables 1 and 2 at 90 degree phase difference: at this value of phase difference, the antenna system 70 has a substantially linear phase front across the antenna elements at two angles of electrical tilt and an equal phase front at a mean angle of tilt. Radial arrows such as 80 terminating at $\mathbf{82}_1$ to $\mathbf{82}_{10}$ indicate the magnitudes and phase angles of the phased array drive signals as they appear at the antenna elements $\mathbf{62}_1$ to $\mathbf{62}_{10}$ respectively. Oblique arrows such as 84 indicate radius vector offsets (e.g. 0.73b or 0.32a) from radius vector A or B. Two arrows 84*a* and 84*b* labelled +0.73B and +0.73A are treated in the drawing as subsuming adjacent arrows 84 labelled +0.32B and +0.32A, and thereby extending back to radius vectors A and B respectively.

Bi-directional arrows such as 86 indicate phase differences between adjacent radius vectors, the phase difference being 22 degrees between signals on outermost pairs of antenna elements $\mathbf{62}_1/\mathbf{62}_2$ and $\mathbf{62}_9/\mathbf{62}_{10}$ and 18 degrees between all other pairs $\mathbf{62}_2/\mathbf{62}_3$ to $\mathbf{62}_8/\mathbf{62}_9$. The difference between 18 and 22 degrees is small in the context of a phased array: for practical purposes therefore, phase differences between adjacent pairs of antenna elements $\mathbf{62}_i/\mathbf{62}_{i+1}$ (i=1 to 9) are substantially constant and the phase variation across the array 62 is a substantially linear function of position in the array as required for normal phased array operation.

As has been said FIG. 5 represents the situation for 90 degrees of phase difference between the signals A and B or V2A and V2B. A phase difference of zero corresponds to a mean angle of tilt, and positive and negative phase differences correspond to positive and negative angles of antenna tilt.

Figure 6:
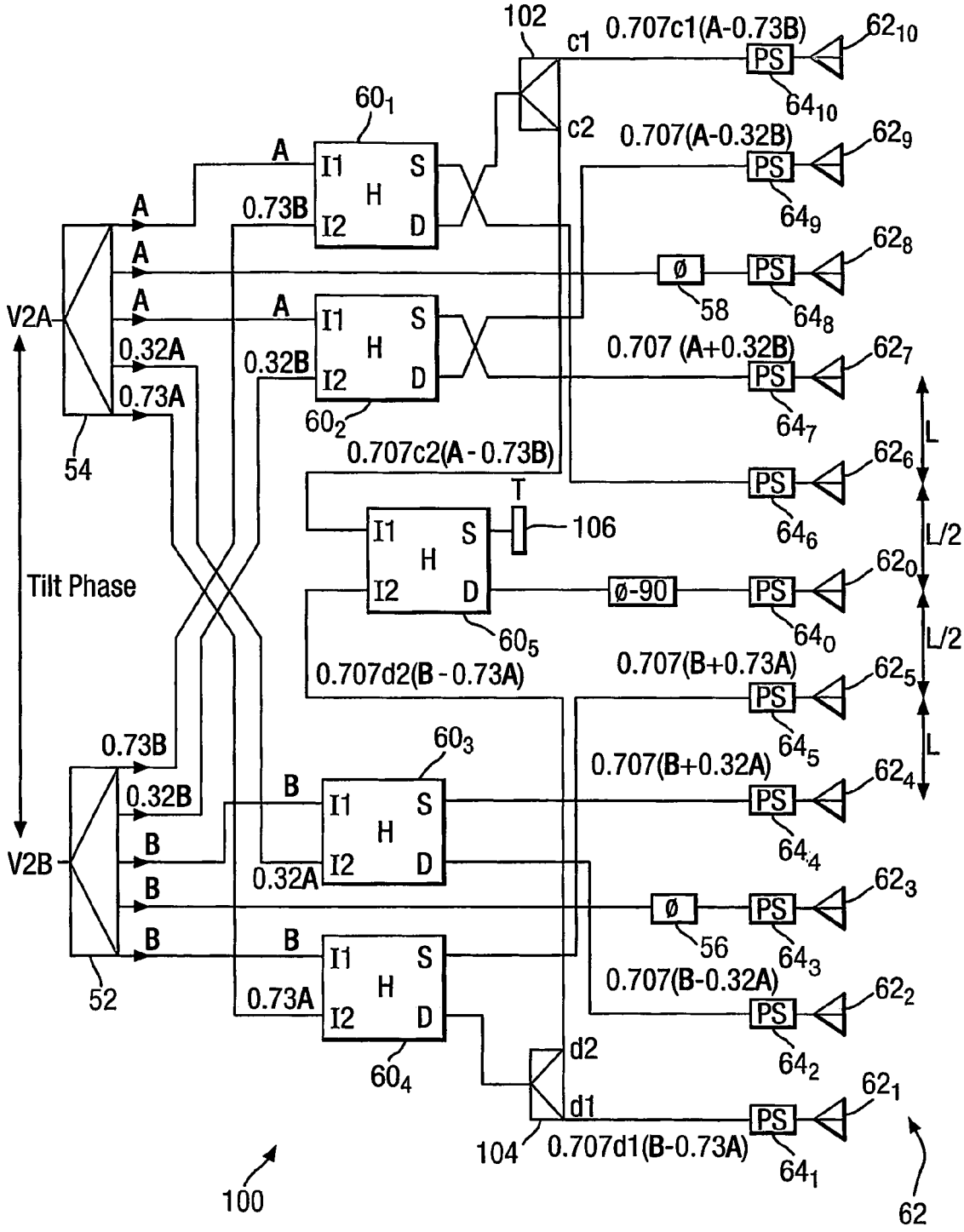
FIGS. 6 and 7 are block diagrams of parts of further phased array antenna systems of the invention incorporating eleven and twelve antenna elements respectively (element spacing is not wholly to scale in FIG. 6)

Referring now to FIG. 6, there is shown part of an antenna system 100 of the invention involving an odd number of antenna elements, eleven in this example. The system 100 is equivalent to the example 70 with the addition of a small number of components, and the description which follows will concentrate on aspects of difference. Parts equivalent to those previously described are like referenced. The system 100 differs to that described earlier in that the difference outputs D of hybrids $\mathbf{60}_1$ and $\mathbf{60}_4$ are not connected to phase shifters $\mathbf{64}_1$ and $\mathbf{64}_{10}$ but instead to two way splitters 102 and 104 respectively. These splitters divide signals from the hybrids $\mathbf{60}_1$ and $\mathbf{60}_4$ into respective amplitude fractions c1/c2 and d1/d2: of these, c1 and d1 are fed to phase shifters $\mathbf{64}_1$ and $\mathbf{64}_{10}$ for use in driving antenna elements $\mathbf{62}_1$ and $\mathbf{62}_{10}$. Fractions c2 and d2 are respectively fed to I1 and I2 inputs of an additional fifth hybrid 605 of the same type as hybrids $\mathbf{60}_1$ and $\mathbf{60}_4$. The fifth hybrid 605 has a sum output S which is terminated in a matched load 106, and a difference output D which is connected to an additional centrally located antenna element $\mathbf{62}_0$ via a $\phi-90$ degree phase shifter 108 and an antenna phase shifter $\mathbf{64}_0$. In FIG. 5, all antenna elements are equispaced by a distance L say, so introduction of the central antenna element $\mathbf{62}_0$ means that it is spaced by L/2 from neighbouring elements $\mathbf{62}_5$ and $\mathbf{62}_6$ (this is as marked in the drawing but for convenience the spacing is illustrated as being larger than is actually the case). However, such L/2 spacing is not essential.

The net effect of the modifications in FIG. 6 at the antenna array 62 is that elements $\mathbf{62}_1$ and $\mathbf{62}_{10}$ have drive signals reduced to d1(B−0.73A) and c1(A−0.73B), and the extra central element 620 has a drive signal d2(B−0.73A)−c2(A−0.73B).

It can be shown that the antenna system 100 has an asymmetrical Vertical Radiation Pattern when tilted downwards compared to that when tilted upwards. There is an increase in signal power fed to end antenna elements $\mathbf{62}_1$ and $\mathbf{62}_{10}$ when the antenna array 62 is electrically tilted either upwards or downwards. Ideally the side lobe level would be optimally controlled when drive signal variation across the array (amplitude taper) remains substantially constant over the antenna tilt range. In order to offset consequential effects on side lobes due to increased power at end antenna elements $\mathbf{62}_1$ and $\mathbf{62}_{10}$ when tilted, a number of techniques may be used as follows:

1. attenuators may be inserted in series with the end antenna elements $\mathbf{62}_1$ and $\mathbf{62}_{10}$;
2. the end antenna elements $\mathbf{62}_1$ and $\mathbf{62}_{10}$ may each be split into two, adding a further two elements to the antenna;
3. power may be partly diverted from the end antenna elements $\mathbf{62}_1$ and $\mathbf{62}_{10}$ to elements near the centre of the antenna using further hybrids; and
4. part of the power from the end antenna elements $\mathbf{62}_1$ and $\mathbf{62}_{10}$ may be used to drive the central element $\mathbf{62}_0$, as in fact is shown in FIG. 6.

The antenna system 100 offers the following advantages:

1. the antenna side lobe level is reduced when the antenna array 62 is electrically tilted.
2. the phase of the carrier or drive signal of the centre element $\mathbf{62}_0$ changes by 180 degrees as the electrical tilt passes through a mean value and further reduces the level of the upper side lobe when tilted downwards.
3. The effect of reducing the level of the upper side lobe when the antenna is tilted downwards is to reduce the interference caused to mobiles using channels other than that assigned to the antenna system 100.

Figure 7:
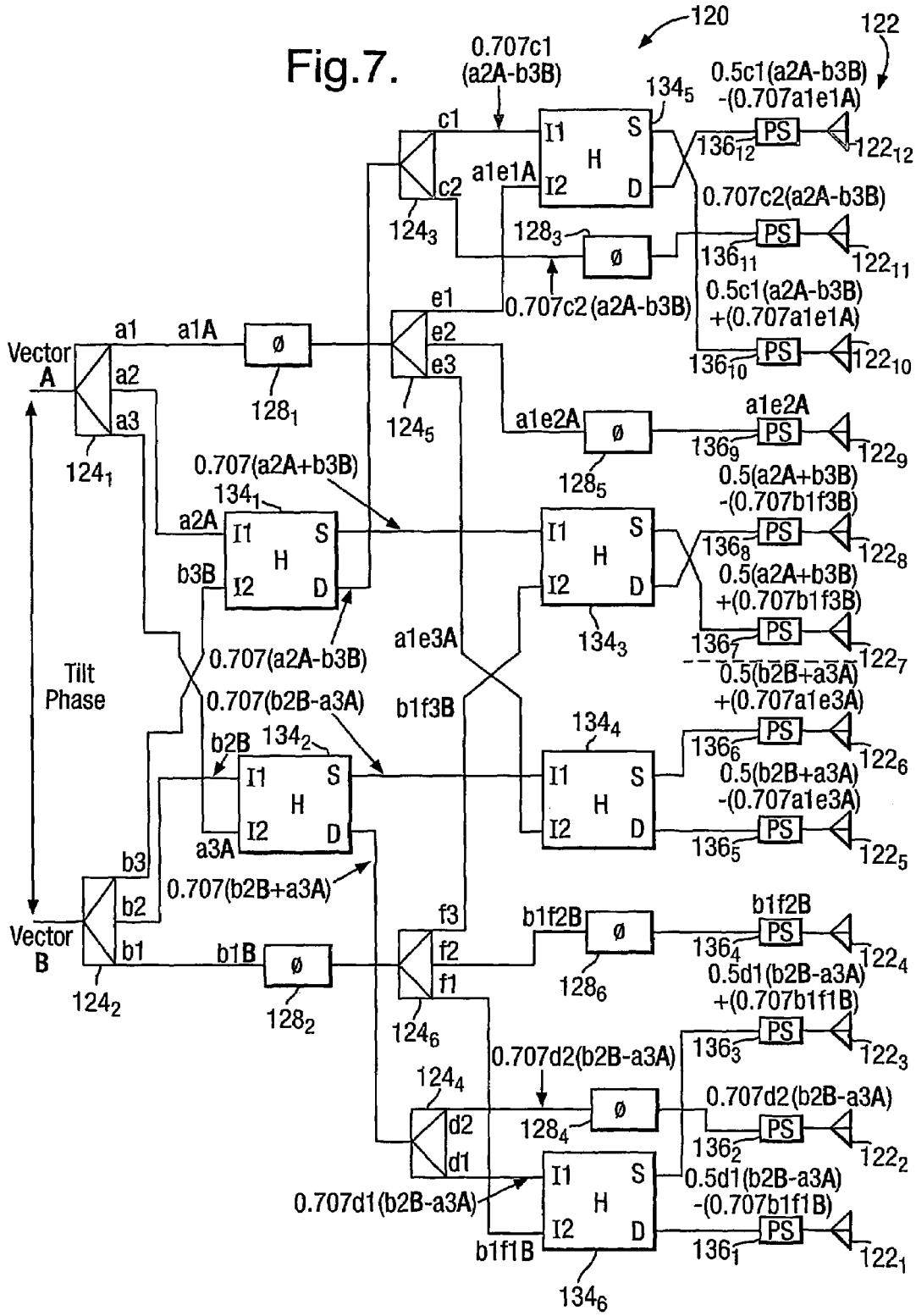

Referring now to FIG. 7, there is shown part of an implementation 120 of the invention for a phased array 122 of twelve elements $\mathbf{122}_1$ to $\mathbf{122}_{12}$. First and second splitters $\mathbf{124}_1$ and $\mathbf{124}_2$ respectively receive input signals denoted in this case by vectors A and B: these vectors are of equal power but variable relative phase. The splitters $\mathbf{124}_1$ and $\mathbf{124}_2$ implement division into three fractions a1/a2/a3 and b1/b2/b3 respectively: i.e. signals a1A, a2A and a3A are output from splitter $\mathbf{124}_1$ and signal fractions b1B, b2B and b3B from splitter $\mathbf{124}_2$. Signals a1A and b1B pass to first and second $\phi$ padding phase shifters $\mathbf{128}_1$ and $\mathbf{128}_2$ respectively. Signals a2A and b3B pass to I1 and I2 inputs of a first 180 degree hybrid $\mathbf{134}_1$ of the kind described earlier. Signals b2B and a3A pass to I1 and I2 inputs of a second hybrid $\mathbf{134}_2$. The hybrids $\mathbf{134}_1$ and $\mathbf{134}_2$ have difference outputs D connected as inputs to third and fourth splitters $\mathbf{124}_3$ and $\mathbf{124}_4$, which produce two-way splitting into fractions c1/c2 and d1/d2 respectively. They also have sum outputs S connected to I1 inputs of third and fourth hybrids $\mathbf{134}_3$ and $\mathbf{134}_4$ respectively.

Output signals from the first and second phase shifters $\mathbf{128}_1$ and $\mathbf{128}_2$ pass to fifth and sixth splitters $\mathbf{124}_5$ and $\mathbf{124}_6$ producing three-way splitting into fractions e1/e2/e3 and f1/f2/f3 respectively. Output signals from the third splitter $\mathbf{124}_3$ pass (fraction c1) to an I1 input of a fifth hybrid $\mathbf{134}_5$ and (fraction c2) to a third $\phi$ padding phase shifter $\mathbf{128}_3$. Output signals from the fourth splitter $\mathbf{124}_4$ pass (fraction d1) to an I1 input of a sixth hybrid $134_6$ and (fraction d2) to a fourth ϕ padding phase shifter $128_4$. Output signals from the fifth splitter $124_5$ pass (fraction e1) to an I2 input of the fifth hybrid $134_5$, (fraction e2) to a fifth ϕ padding phase shifter $128_5$ and (fraction e3) to an I2 input of the fourth hybrid $134_4$. Output signals from the sixth splitter $124_6$ pass (fraction f1) to an I2 input of the sixth hybrid $134_6$, (fraction f2) to a sixth ϕ padding phase shifter $128_6$ and (fraction f3) to a I2 input of the third hybrid $134_3$. Via respective fixed phase shifters (PS) $136_1$ to $136_{12}$, the antenna elements $122_1$ to $122_{12}$ receive drive signals from outputs of the third to sixth hybrids $134_3$ and $134_6$ and third to sixth phase shifters $128_3$ and $128_6$ as set out in Table 3 below.

TABLE 3

| Element | Hybrid or Phase Shifter | Signal Amplitude |
|---|---|---|
| $122_1$ | Hybrid $134_6$, output D | 0.5d1(b2B − a3A) − 0.707b1f1B |
| $122_2$ | Phase Shifter $128_4$ | 0.707d2(b2B − a3A) |
| $122_3$ | Hybrid $134_6$, output S | 0.5d1(b2B − a3A) + 0.707b1f1B |
| $122_4$ | Phase Shifter $128_6$ | b1f2B |
| $122_5$ | Hybrid $134_4$, output D | 0.5(b2B + a3A) − 0.707a1e3A |
| $122_6$ | Hybrid $134_4$, output S | 0.5(b2B + a3A) + 0.707a1e3A |
| $122_7$ | Hybrid $134_3$, output S | 0.5(a2A + b3B) + 0.707b1f3B |
| $122_8$ | Hybrid $134_3$, output D | 0.5(a2A + b3B) − 0.707b1f3B |
| $122_9$ | Phase Shifter $128_5$ | a1e2A |
| $122_{10}$ | Hybrid $134_5$, output S | 0.5c1(a2A − b3B) + 0.707a1e1A |
| $122_{11}$ | Phase Shifter $128_4$ | 0.707c2(a2A − b3B) |
| $122_{12}$ | Hybrid $134_5$, output D | 0.5c1(a2A − b3B) + 0.707a1e1A |

Because all the terms a1 to f3 are fractions, all signal powers are in terms of fractions of signal vectors A and B input to the first and second splitters $124_1$ and $124_2$ respectively.

The phase shifters $128_1$ to $128_6$ provide compensation for the phase shift that takes place in a hybrid (e.g. $134_1$). Consequently, signals or signal components that do not pass via one or more hybrids traverse two phase shifters (e.g. $128_1$) and receive a phase shift of 360 degrees before reaching antenna elements $122_3$ and $122_9$. In addition, signals or signal components that pass via one hybrid traverse one phase shifter (e.g. $128_4$) and receive a relative phase shift of ϕ before reaching antenna elements (e.g. $122_2$).

TABLE 4

| | | Splitter Ratios | |
|---|---|---|---|
| Splitter | Splitter Output | Voltage | Decibels |
| $124_1$, $124_2$ | a1A, b1B | 0.4690 | −6.58 |
| | a2A, b2B | 0.8290 | −1.63 |
| | a3B, b3B | 0.3040 | −10.34 |
| $124_3$, $124_4$ | 0.707c1(a2A − b3B), 0.707d1(b2B − a3A) | 0.800 | −1.94 |
| | 0.707c2(a2A − b3B), 0.707d2(b2B − a3A) | 0.600 | −4.43 |
| $124_5$, $124_6$ | a1e1A, a1e3A, b1f1B, b1f3B | 0.2357 | −12.55 |
| | a1e2A, b1f2B | 0.9428 | −0.51 |

Table 4 gives splitter ratios; amplitudes (voltages) are calculated from powers normalised to sum to 1 watt.

Figure 8:
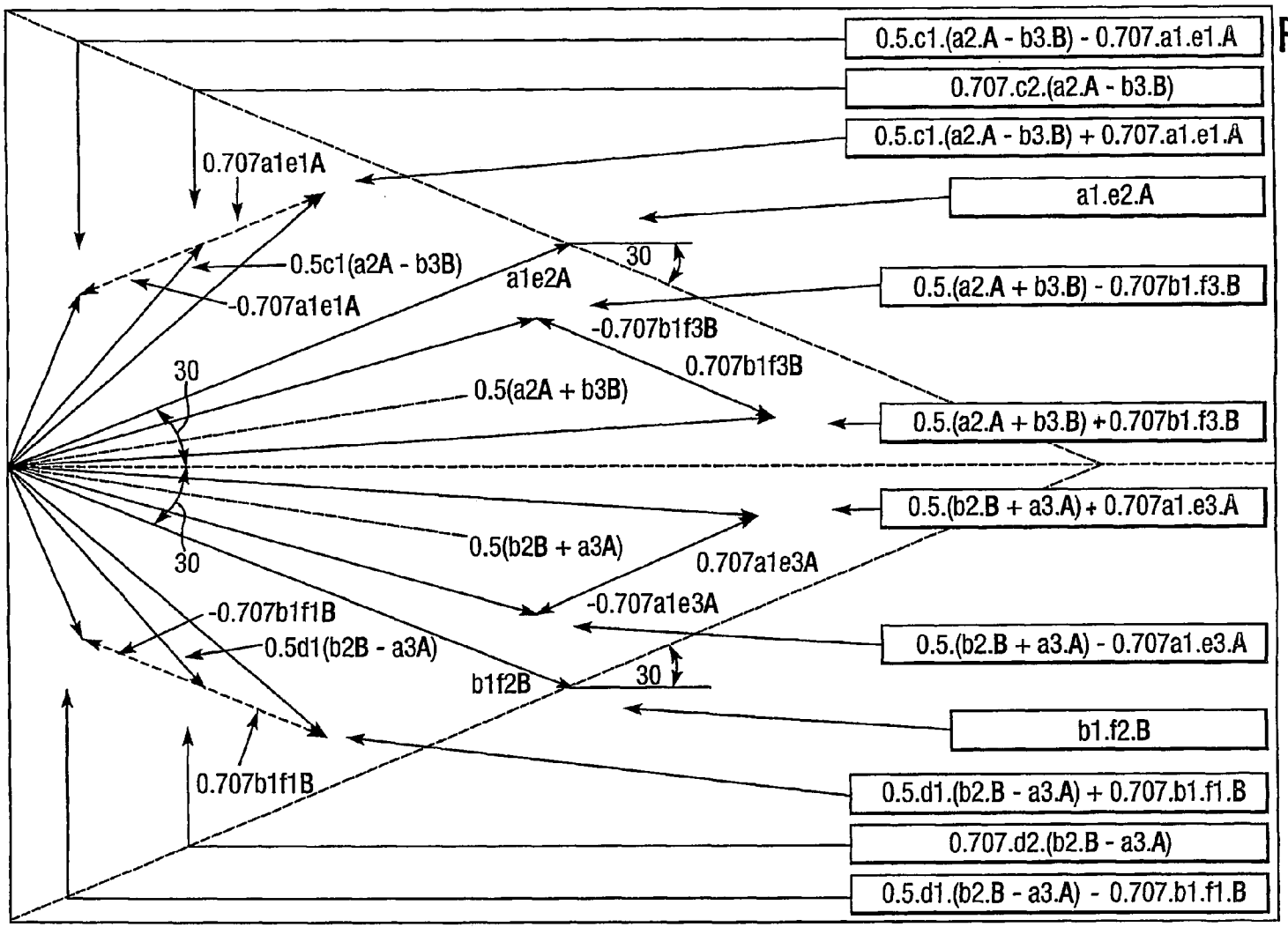
FIG. 8 is a phase diagram of antenna element signals associated with a ninety degree phase shift introduced by a variable phase shifter in the FIG. 7 system.

Referring now also to FIG. 8, there is shown a vector diagram for the antenna system 120 when the phase difference between input signal vectors A and B is 60 degrees, which is the angle at which the phase front of the antenna array 122 is optimised in this example. Antenna element drive signals are indicated in magnitude and phase by solid radius vector arrows with antenna element reference numerals $122_1$ to $122_{12}$ and signal powers (e.g. a1*e*2A). Components (e.g. a1*e*1A) of such signals are indicated by chain or dotted line vectors. Signals b1*f*2B and a1*e*2A on respective antenna elements $122_4$ and $122_9$ are fractions of and are in phase with input signal vectors A and B, and they are 60 degrees apart in phase as indicated by two bidirectional arrows each marked 30 degrees. This drawing contains full information regarding signal magnitude and phase, and will not be described further.

Figure 9:
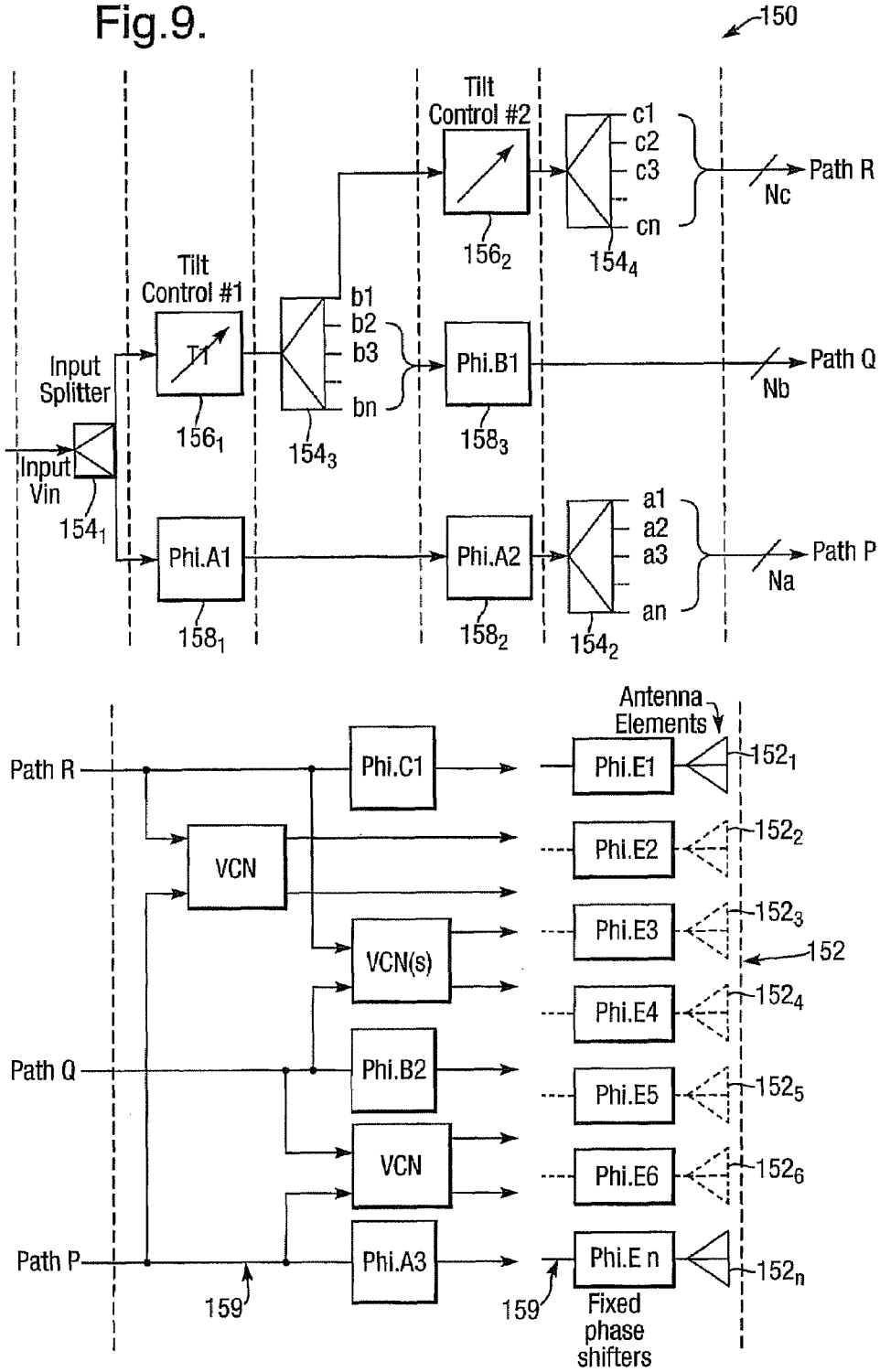
FIG. 9 is a block diagram of part of another phased array antenna system of the invention employing two variable phase shifters.

Referring now to FIG. 9, an antenna system 150 of the invention is shown for a phased array 152 of n elements $152_1$ to $152_n$ employing double variable delay, n being an arbitrary positive integer. A first splitter $154_1$ receives an input signal Vin, and splits it into two signals one of which has twice the power of the other. Of these two signals, the higher powered signal is routed to a first variable phase shifter $156_1$ and the lower powered signal to a first fixed phase shifter $158_1$ The first fixed phase shifter $158_1$ provides an output signal via a second fixed phase shifter $158_2$ to a second splitter $154_2$, which splits it into n signal fractions a1 to an for output via a bus indicated by Path P. The first variable phase shifter $156_1$ provides an output signal to a third splitter $154_3$ which splits it into n signal fractions b1 to bn. Signal fractions b2 to bn are output via a third fixed phase shifter $158_3$ and a bus indicated by Path Q. Signal fraction b1 has equal power to that of the signal fed to the first fixed phase shifter $158_1$, and it is routed to a second variable phase shifter $156_2$ and thence to a fourth splitter $154_4$, which splits it into n signal fractions c1 to cn for output via a bus indicated by Path R. The buses indicated by Paths P, Q and R have Na, Nb and Nc individual conductors respectively.

The signal fractions on Paths P, Q and R pass to a signal combining and phase shifting network indicated generally by 159. The network 159 is similar to that described with reference to FIGS. 3 and 4, and will not be described further. It has the function of combining and phase shifting signals to produce antenna element drive signals that vary appropriately for the phased array 152. The use of two variable phase shifters $156_1$ and $156_2$ is not essential, but it increases the range of angles over which an antenna can be tilted electrically as compared to the use of only one such. FIG. 9 may be extended with additional combinations of variable phase shifters and splitters if a larger range of tilt is required: i.e. just as b1 is variably phase shifted at $156_2$ and split at $154_4$, c1 may be variably phase shifted and split to produce d1 to dn, d1 may be variably phase shifted and split to produce e1 to en, and so on.

Figure 10:
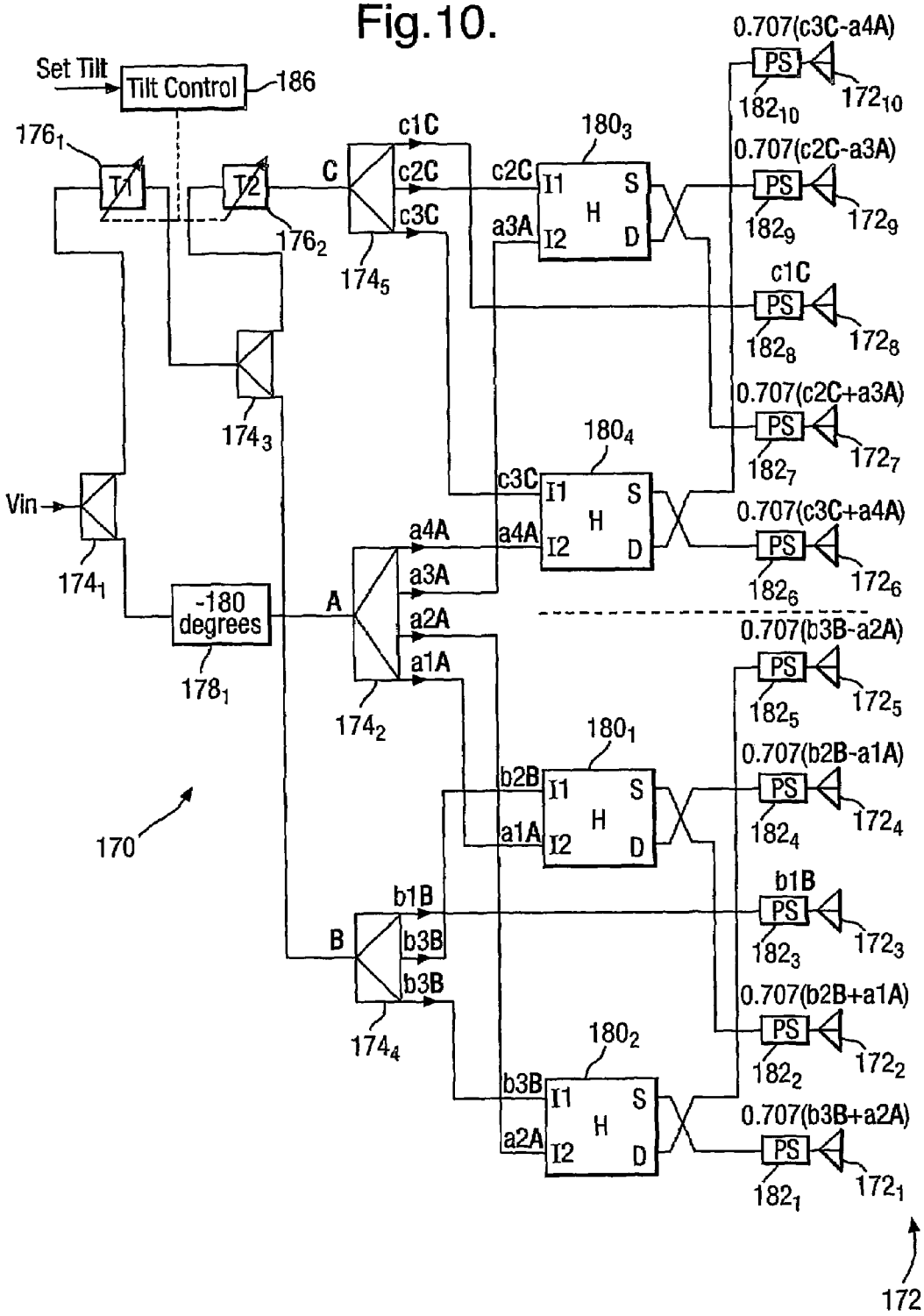
FIG. 10 is a block diagram of part of an antenna system of the invention similar to that shown in FIG. 9 but employing ganged variable phase shifters.

Referring now to FIG. 10, there is shown an antenna system 170 of the invention for a phased array 172 of ten elements $172_1$ to $172_{10}$ employing ganged double variable delay. It is a variant of the system 150 described with reference to FIG. 9. A first splitter $174_1$ receives an input signal Vin, and splits it into two signals one of which has twice the power of the other. Of these two signals, the higher powered signal is routed to a first variable phase shifter $176_1$ and the lower powered signal to a first −180 degree phase shifter $178_1$. The signal passing to the first phase shifter $178_1$ is designated as a vector A. It provides an output signal to a second splitter $174_2$, which splits the output signal into four signals a1A to a4A.

The first variable phase shifter $176_1$ provides an output signal to a third splitter $174_3$ which splits that output signal into two signals of magnitude equal to that of vector A: one of these two signals is designated as a vector B, and it passes to a fourth splitter $174_4$ which splits it into three signals b1B to b3B. The other of these two signals passes via a second variable phase shifter $176_2$ to a fifth splitter $174_5$ at which it is designated as a vector C, and which splits it into three signals c1C to c3C.

Signals b1B and c1C pass to antenna elements $172_3$ and $172_8$ via antenna phase shifters $182_3$ and $182_8$ respectively.

Signals b2B, b3B, c2C and c3C respectively provide I1 input signals to first, second, third and fourth 180 degree hybrids $180_1$, $180_2$, $180_3$ and $180_4$ of the kind described earlier. These hybrids provide a signal combining network. Signals a1A to a4A provide I2 input signals to these hybrids respectively. Via respective fixed phase shifters (PS) $182_1$, $182_2$, $182_4$ to $182_7$, $182_9$ and $182_{10}$, the antenna elements $172_1$, $172_2$, $172_4$ to $172_7$, $172_9$ and $172_{10}$ receive drive signals from outputs of the hybrids $180_1$ to $180_4$ with amplitudes as set out in Table 4 below, to which the equivalents for elements $172_3$ and $172_8$ have been added. Here N/A means not applicable.

TABLE 5

| Antenna Element | Hybrid Output | Signal Amplitude |
|---|---|---|
| $172_1$ | Hybrid $180_2$, output S | 0.707(b3B + a2A) |
| $172_2$ | Hybrid $180_1$, output S | 0.707(b2B + a1A) |
| $172_3$ | N/A | b1B |
| $172_4$ | Hybrid $180_1$, output D | 0.707(b2B − a1A) |
| $172_5$ | Hybrid $180_2$, output D | 0.707(b3B − a2A) |
| $172_6$ | Hybrid $180_4$, output S | 0.707(c3C + a4A) |
| $172_7$ | Hybrid $180_3$, output S | 0.707(c2C + a3A) |
| $172_8$ | N/A | c1C |
| $172_9$ | Hybrid $180_3$, output D | 0.707(c2C − a3A) |
| $172_{10}$ | Hybrid $180_4$, output D | 0.707(c3C − a4A) |

Values of splitter ratios are given in Table 6 below, where as before voltages have been calculated from powers normalised to sum to 1 watt.

TABLE 6

| | | Splitter Ratios | |
|---|---|---|---|
| Splitter | Splitter Output | Voltage | Decibels |
| $174_2$ | a1A, a3A | 0.3162 | −10.00 |
| | a2A, a4A | 0.6324 | −3.98 |
| $174_4$ | b1B, b2B, b3B | 0.577 | −4.78 |
| $174_5$ | c1C, c2C, c3C | 0.577 | −4.78 |

The variable phase shifters $176_1$ and $176_2$ are ganged as indicated by arrows and dotted lines so that they vary together and give equal phase shifts. They are controlled by a tilt control mechanism 186. It can be seen from FIG. 10 that only the upper half of the array 172 (antenna elements $172_6$ to $172_{10}$) receives signal contributions associated with fractions c1 etc. from the fifth splitter $174_5$, these contributions having undergone two variable phase shifts at $176_1$ and $176_2$. Moreover, only the lower half of the array 172, i.e. antenna elements $172_1$ to $172_5$, receive signal contributions associated with fractions b1 etc. from the fourth splitter $174_5$, these contributions having undergone one variable phase shift at $176_1$. Both halves of the array 172 (other than antenna elements $172_3$ and $172_8$) receive signal contributions a1A etc. from the second splitter $174_2$, these contributions not having undergone a variable phase shift at $176_1$ or $176_2$.

Figure 11:
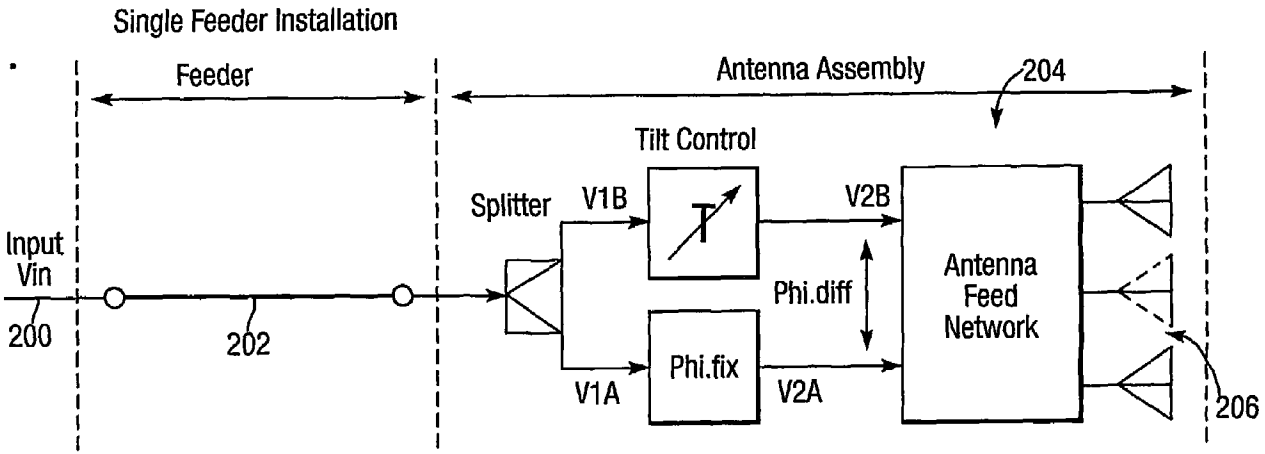
FIGS. 11 and 12 illustrate use of the invention with single and dual feeders respectively.

Referring now to FIG. 11, the antenna system of the invention may be implemented as a single feeder system or a dual feeder system. In a single feeder system, a single signal input 200 supplies a signal Vin via a feeder 202 to an antenna assembly 204 which may be mounted on a mast with an antenna array 206. Signal splitting, variable and fixed phase shifting and vectorial combining as described earlier is implemented in the assembly 204 on the mast. This has the advantage that only one signal feed is required to pass to the antenna system from a remote user, but against that a remote operator cannot adjust the angle of electrical tilt without access to the antenna assembly 204 on the mast. Also, operators sharing a single antenna would all have the same angle of electrical tilt.

Figure 12:
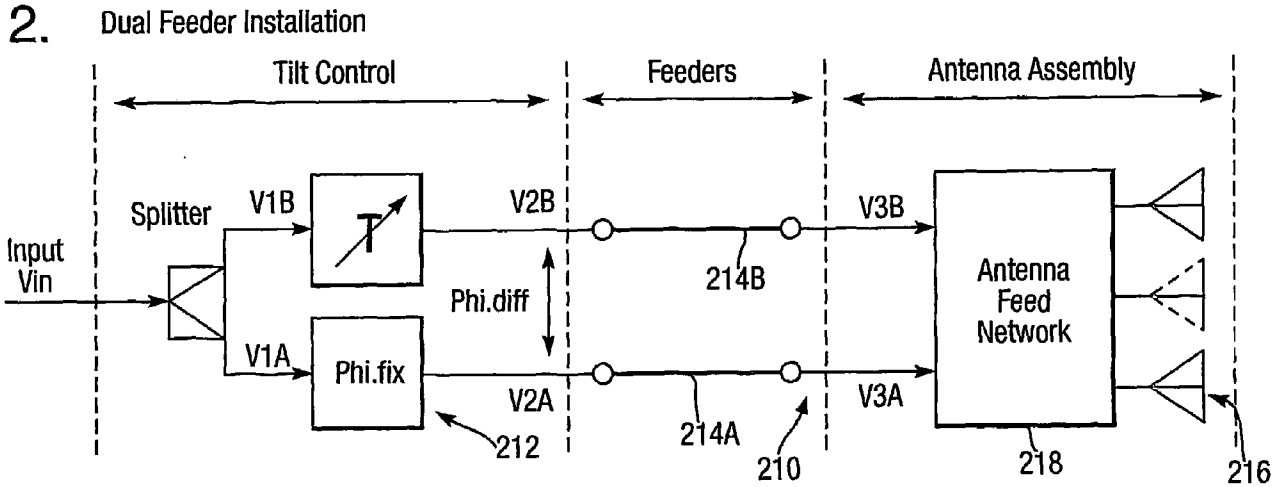

FIG. 12 shows an antenna system of the invention implemented as a dual feeder system 210. This system has a tilt control section 212 which generates two signals V2A and V2B as described earlier, and these signals are fed via respective feeders 214A and 214B to an antenna array 216. The tilt control section 212 may now be located with a user remotely from the antenna array 60 and mast on which it is mounted, and an antenna feed network 218 (see e.g. FIG. 4) may be co-located with the antenna array 216. Signal splitting, fixed phase shifting (if desired further variable phase shifting also) and vector combining as described earlier is implemented in the assembly 216. A user may now have direct access to the tilt control section 212 to adjust the angle of electrical tilt remotely from the antenna array 60 and mast, and may make this adjustment independently of other users sharing the antenna assembly 216.

In a dual feeder installation it is also convenient to reduce tilt sensitivity to lessen the effects of phase differences between feeders, e.g. a difference between the angle of electrical tilt required by the operator and that at the antenna. With a respective tilt control section 212 located with each operator, and at an input side of a frequency selective combiner located at an operator's base station, it is possible to implement a shared antenna system with an individual angle of tilt for each operator.

Figure 13:
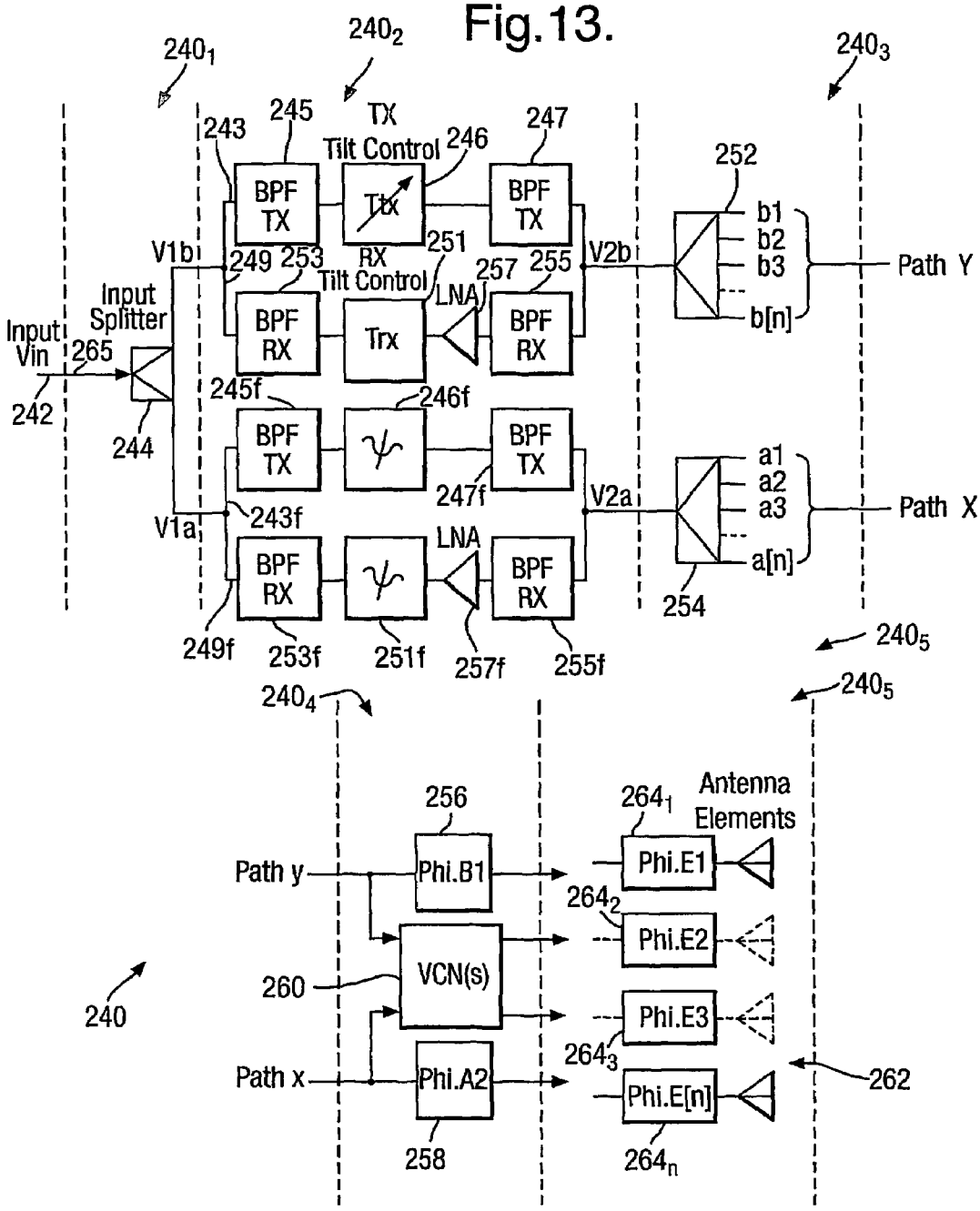
FIG. 13 shows a modification to the invention allowing angles of electrical tilt in transmit mode and receive mode to be independently adjustable.

FIG. 13 shows a phased array antenna system 240 of the invention equivalent to that shown in FIG. 3 with modification for use in both receive and transmit modes. Parts previously described are like-referenced with a prefix 200 and only changes will be described. A variable phase shifter 246 with which tilt is controlled is now used in transmit (Tx) mode only, and is connected in a transmit path 243 between and in series with bandpass filters (BPF) 245 and 247. There is also a similar receive (Rx) path 249 with a variable phase shifter 251 between and in series with bandpass filters 253 and 255 and a low noise amplifier or LNA 257. Transmit and receive frequencies are normally sufficiently different to allow them to be isolated from one another by bandpass filters 245 etc.

There are further and largely equivalent second transmit and receive paths 243*f* and 249*f* associated with fixed phase shifts ψ: these have like-referenced elements with a suffix f. The second transmit path 243*f* has a fixed phase shifter 246*f* between band pass filters 245*f* and 247*f*. The second receive path 249*f* has a fixed phase shifter 251*f* and LNA 257*f* between band pass filters 253*f* and 255*f*.

In addition to operating in transmit mode, elements 242, 244, 252, 254, 256 and 258 to 265 have the capability of operating in reverse in receive mode with e.g. splitters becoming combiners. The only difference between the two modes is that in transmit mode the feeder 265 provides input and transmit paths 243 and 243*f* are traversed by a transmit signal from left to right, whereas in receive mode receive paths 249 and 249*f* are traversed by receive signals from right to left and feeder 265 provides their combined output. The receive signals are generated in circuitry $264_1$ to $264_n$ and 260 to 254 by phase shifting and combining antenna element signals generated by the array 262 in response to receipt of a signal from free space. The system 240 is advantageous because it allows angles of electrical tilt in both transmit and receive modes to be independently adjustable and to be made equal: normally (and disadvantageously) this is not possible because antenna system components have frequency-dependent properties which differ at different transmit and receive frequencies.

Figure 14:
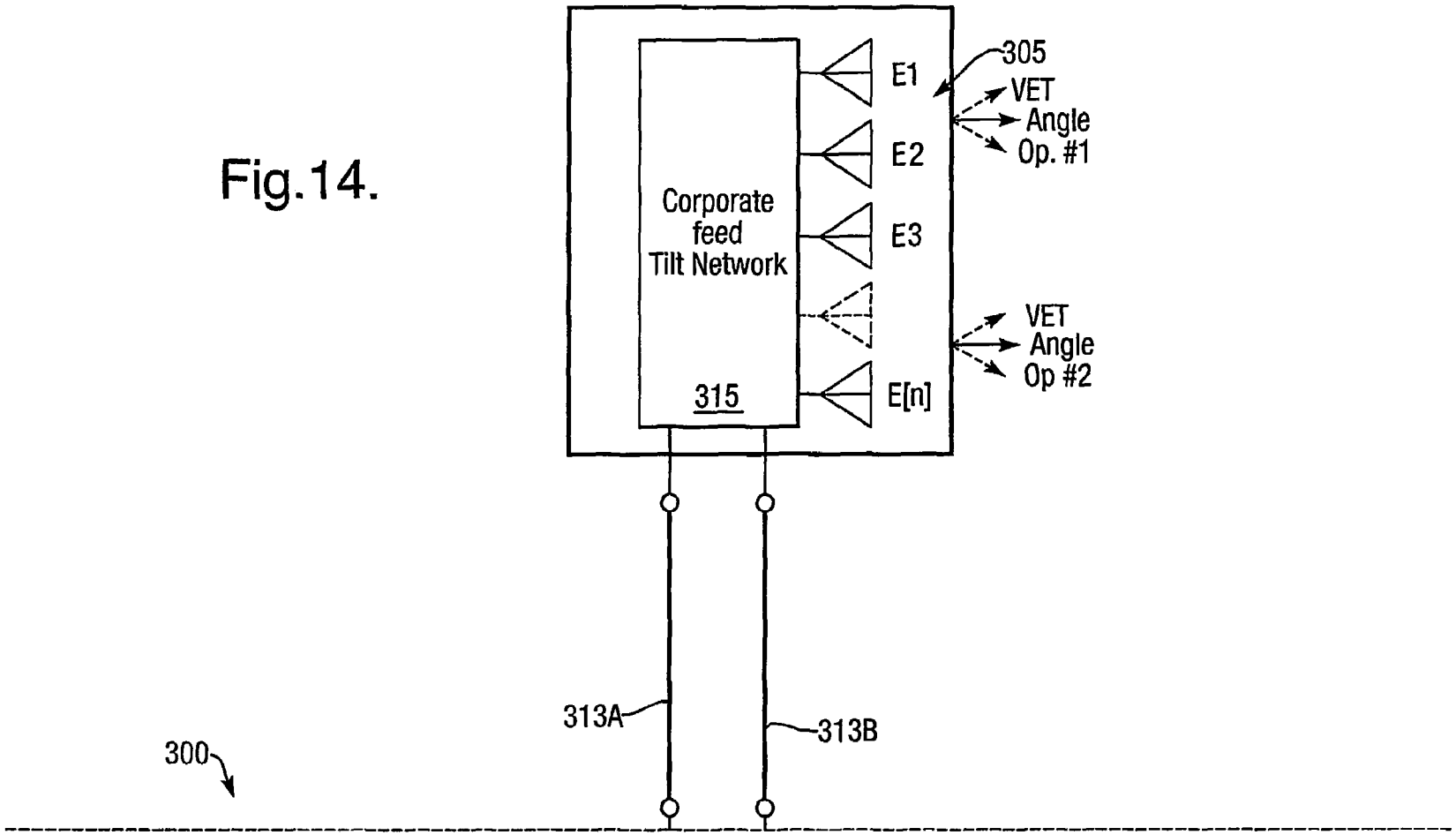
FIG. 14 is a block diagram of another phased array antenna system of the invention illustrating antenna sharing by multiple users with dual feeders and individual tilt and transmit/receive capability.
Figure 14:
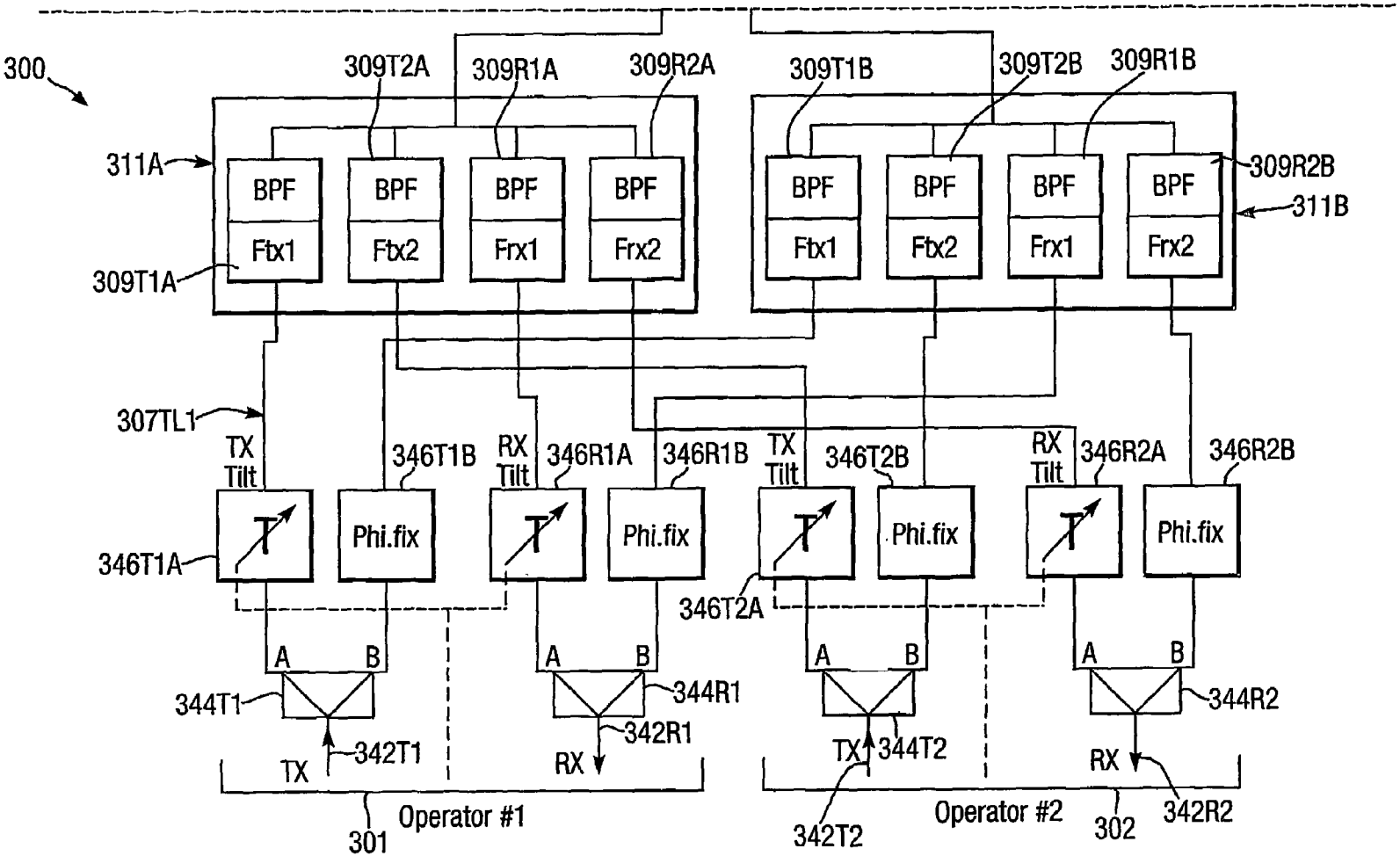

Referring now to FIG. 14, a phased array antenna system 300 of the invention is shown for use in transmit and receive modes by multiple (two) operators 301 and 302 of a single phased array antenna 305. Parts equivalent to those previously described are like-referenced with a prefix 300. The drawing has a number of different channels: parts in different channels which are equivalent are numerically like-referenced with one or more suffixes: a suffix T or R indicates a transmit or receive channel, a suffix 1 or 2 indicates first or second operator 301 or 302, and a suffix A or B indicates A or B path. Omission of these suffixes from a reference numeral prefix (e.g. 342) means that all items having that prefix are referred to.

Initially a transmit channel 307T1 of the first operator 301 will be described. This transmit channel has an RF input 342 feeding a splitter 344T1, which divides the input between variable and fixed phase shifters 346T1A and 348T1B. Signals pass from the phase shifters 346T1A and 348T1B to bandpass filters (BPF) 309T1A and 309T1B in different duplexers 311A and 311B respectively. The bandpass filters 309T1A and 309T1B have pass band centres at a transmit frequency of the first operator 301, this frequency being designated Ftx1 as indicated in the drawing. The first operator 301 also has a receive frequency designated Frx1, and equivalents for the second operator 302 are Ftx2 and Frx2.

The first operator transmit signal at frequency Ftx1 output from the leftmost bandpass filter 309T1A is combined by the first duplexer 311A with a like-derived second operator transmit signal at frequency Ftx2 output from an adjacent bandpass filter 309T2A. These combined signals pass along a feeder 313A to an antenna tilt network 315 of the kind described in earlier examples, and thence to the phased array antenna 305. Similarly, the other first operator transmit signal at frequency Ftx1 output from bandpass filter 309T1B is combined by the second duplexer 311B with a like-derived second operator transmit signal at frequency Ftx2 output from an adjacent bandpass filter 309T2B. These combined signals pass along a second feeder 313B to the phased array antenna 305 via the antenna tilt network 315. Despite using the same phased array antenna 305, the two operators can alter their transmit angles of electrical tilt both independently and remotely from the antenna 305 merely by adjusting a single variable phase shifter in each case, i.e. variable phase shifter 346T1A or 346T2A respectively.

Analogously, receive signals returning from the antenna 305 via network 315 and feeders 313A and 313B are divided by the duplexers 311A and 311B. These divided signals are then filtered to isolate individual frequencies Frx1 and Frx2 in bandpass filters 309R1A, 309R2A, 309R1B and 309R2B, which provide signals to variable and fixed phase shifters 346R1A, 346R2A, 348R1B and 348R2B respectively. Receive angles of electrical tilt are then adjustable by the operators 301 and 302 independently by adjusting their respectively variable phase shifters 346R1A and 346R2A. Signals for more than two operators may be combined in transmission or separated in reception by replicating components: i.e. instead of components with suffixes 1 and 2 there would be like components with suffixes 1 to m where m is the number of operators.

Figure 15:
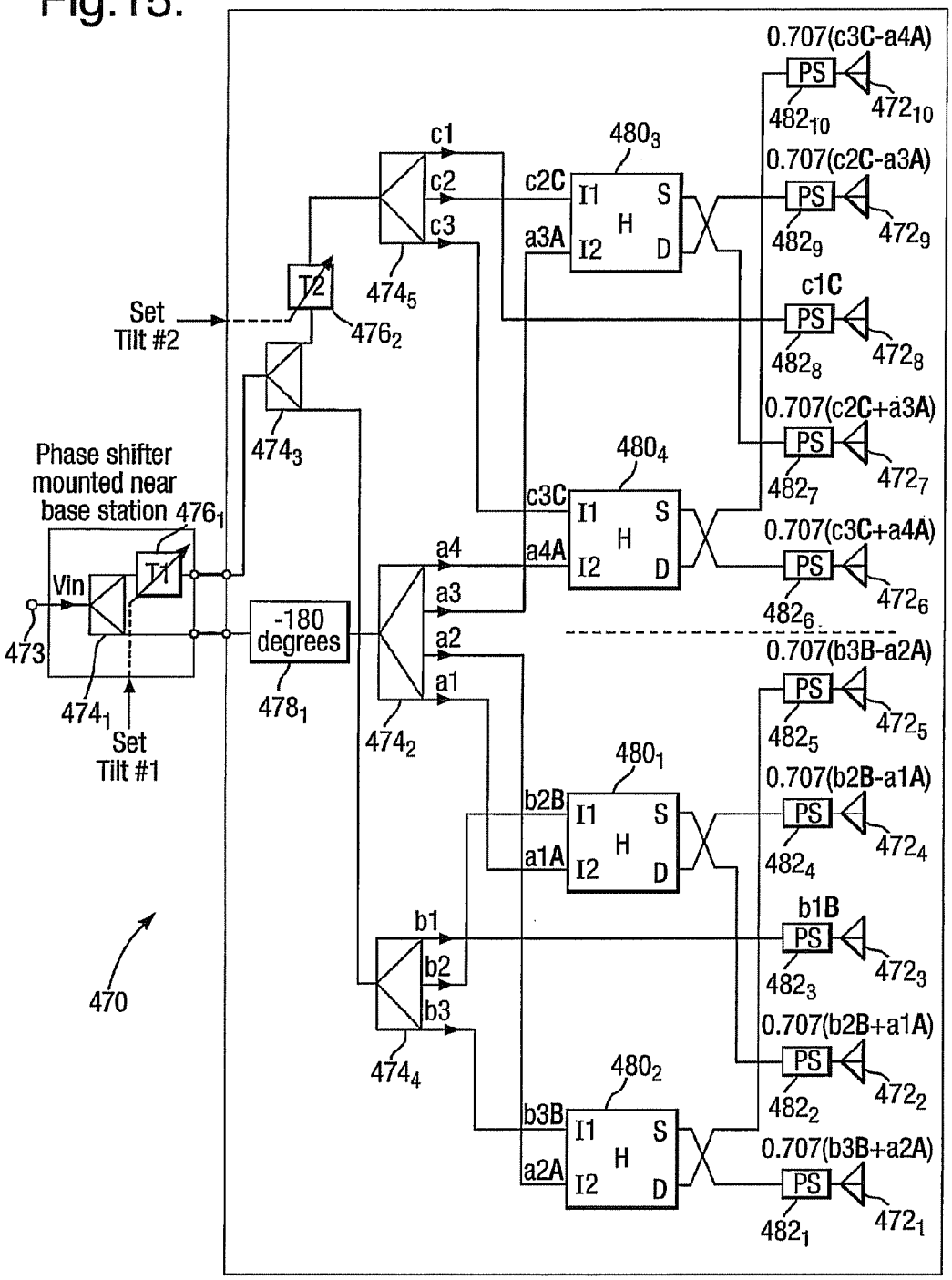
FIG. 15 is a variant of the antenna system of FIG. 9 with variable phase shifters located remotely from one another.

FIG. 15 shows a phased array antenna system 470 of the invention largely the same as that shown in FIG. 10. Parts previously described are like-referenced with a prefix 400 replacing 100 and only modifications will be described. The system 470 has a first splitter $\mathbf{474}_1$ which splits an input RF carrier signal at 473 into two parts, one of which passes via a first variable phase shifter $\mathbf{476}_1$ to a first feeder $\mathbf{477}_1$ and the other directly to a second feeder $\mathbf{477}_2$. The items 473 to $\mathbf{477}_2$ are located in or near a cellular mobile radio base station (not shown). The feeders $\mathbf{477}_1$ and $\mathbf{477}_2$ connect the base station to a remote antenna radome 479, in which a second variable phase shifter $\mathbf{476}_2$ is located.

The system 470 operates as described earlier with reference to FIG. 10, except that the first and second variable phase shifters $\mathbf{476}_1$ and $\mathbf{476}_2$ are no longer ganged but instead are adjusted independently. It provides the advantage that an individual angle of electrical tilt can be provided for each operator sharing the antenna 472 (using frequency selective combining such as that shown in FIG. 14) but the tilt range, common to all operators, is extended. In practice the angle of electrical tilt set by the second variable phase shifter $\mathbf{476}_2$ may conveniently be the average of the individual angles of electrical tilt of all the operators sharing the antenna 472.

Whereas FIG. 15 shows adjustment of the second variable phase shifter $\mathbf{476}_2$ within the antenna radome 479, it may also be set remotely from the radome 479 using a servo mechanism controller (not shown). Further variable phase shifters may be added to the antenna system 470 in accordance with the invention to extend further the range of tilt common to all operators.

Figure 16:
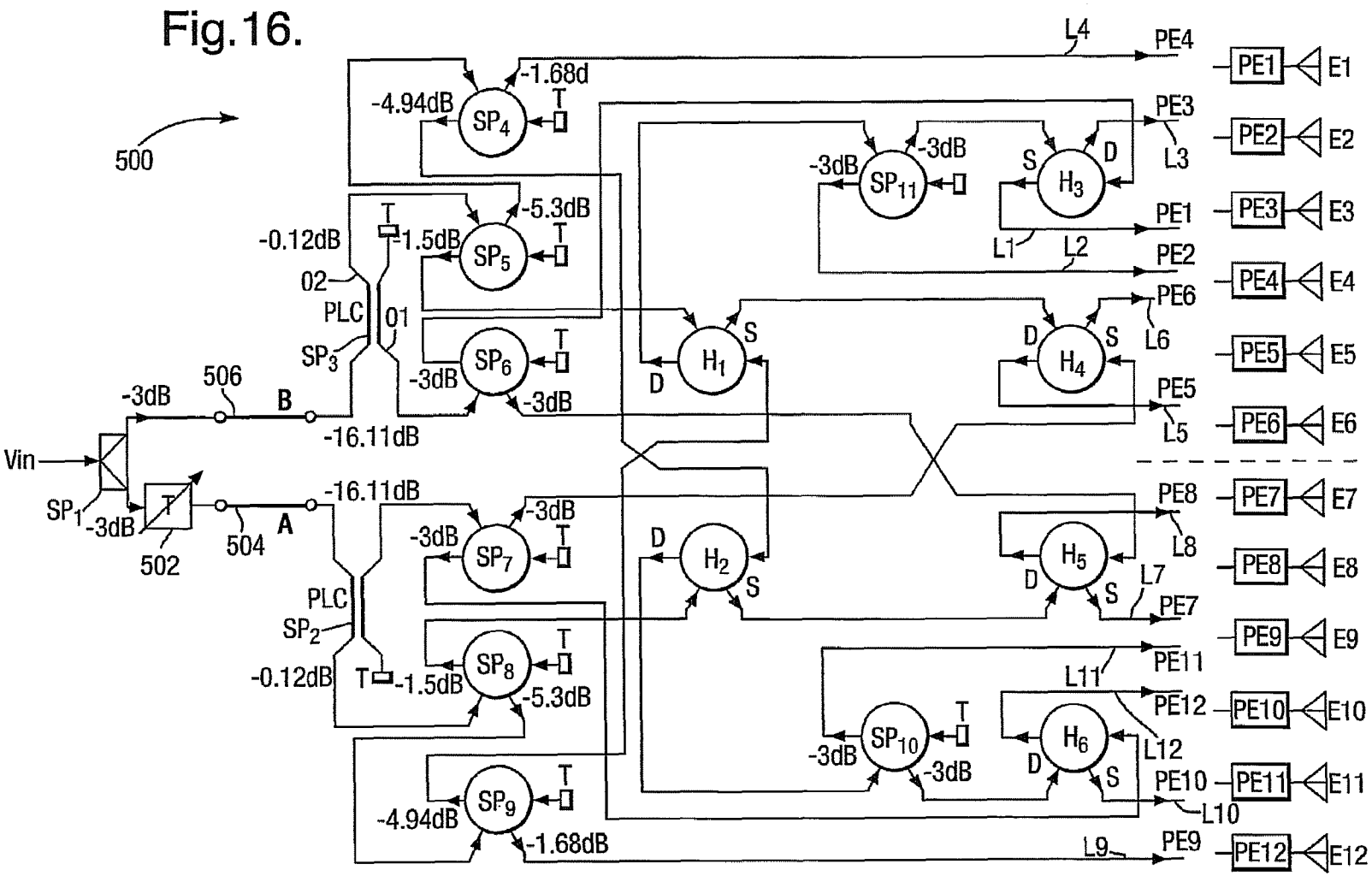
FIG. 16 illustrates a phased array antenna system of the invention incorporating ring hybrid couplers.

FIG. 16 shows a further embodiment of a phased array antenna system 500 of the invention employing an input splitter $SP_1$, parallel line couplers (PLCs) $SP_2$ and $SP_3$ and 180 degree ring hybrids $SP_4$ to $SP_{11}$ and $H_1$ to $H_6$. Here SP in $SP_1$ etc. indicates a splitter and H in $H_1$ etc. indicates a hybrid used as a sum and difference (SD) generator. Each of the hybrids $SP_4$ to $SP_{11}$ and $H_1$ to $H_6$ has four ports, i.e. first and second input ports and first and second output ports indicated respectively by inwardly and outwardly directed arrows. The output ports of each of the SD generator hybrids $H_1$ to $H_6$ are sum and difference outputs indicated by S and D respectively. Each port of an individual ring hybrid $SP_4$ to $SP_{11}$ and $H_1$ to $H_6$ is separated from one port by a distance $\lambda/4$ and from another port by a distance $3\lambda/4$ around the ring circumference in each case. Here $\lambda$ is the wavelength of the signal Vin in the ring material.

A signal applied to an input port of any of the ring hybrids $SP_4$ to $SP_{11}$ and $H_1$ to $H_6$ is split into two components passing respectively clockwise and counter-clockwise around the ring, which itself has a circumference of $(n+\frac{1}{2})\lambda$ where n is an integer: these components have relative amplitudes determined by the relative impedances of the paths in the ring they pass along, which allows splitter ratios to be prearranged. Two signals received from respective input ports distant $\lambda/4$ from an output port will be in phase and will be added together to give a sum output. Two signals received from respective input ports distant $\lambda/4$ and $3\lambda/4$ from an output port will be in antiphase and will be subtracted from one another to give a difference output. At an output port distant $\lambda/2$ from an input port, two signals received via clockwise and counter-clockwise paths respectively from an input port will be in antiphase and will give a zero resultant if path impedances are equal: this therefore isolates ports $\lambda/2$ apart from one another.

Each ring hybrid $SP_4$ to $SP_{11}$ used as a splitter has a first input terminal (inwardly directed arrow) connected to receive an input signal and a second input terminal connected to a respective termination T (a matched load). The termination T provides a zero input signal: consequently the ring hybrids or splitters $SP_4$ to $SP_{11}$ divide signals on their first input terminals between their respective output terminals with respective splitting ratios determined by the ratio of impedances between input and output terminals in each case.

In the system 500, as in earlier embodiments an input signal Vin is divided by the first splitter $SP_1$ into two equal signals which are each reduced to −3 dB compared to the power of the input signal Vin: one signal so formed passes through a variable phase shifter 502 and appears on a first feeder 504 as a vector A. The other, signal so formed appears on a second feeder 506 as a vector B; it is possible to include a fixed phase shift (not shown) between the first splitter $SP_1$ and the second feeder 506 as described earlier.

The signal vectors A and B pass as inputs to the PLCs $SP_2$ and $SP_3$ respectively, each of which has two output terminals O1 and O2 and a fourth terminal $T_4$ terminated in a matched load T providing a zero input signal. From its input each of the PLCs $SP_2$ and $SP_3$ generates signals at output terminals O1 and O2 which are reduced in power to −0.12 dB and −16.11 dB respectively relative to the input signal in each case. The two resulting −0.12 dB signals from the PLCs $SP_2$ and $SP_3$ are fed to the first input terminals of the fifth and eighth splitters $SP_5$ and $SP_8$ respectively, whereas the −16.11 dB signals are fed to the first input terminals of the sixth and seventh splitters $SP_6$ and $SP_7$ respectively.

The fifth splitter $SP_5$ divides its input signal into output signals which are reduced in power below that of the input signal to −5.3 dB and −1.5 dB, and these output signals are fed to the first input terminals of the fourth splitter $SP_4$ and the first SD generator $H_1$ respectively. Similarly, the eighth splitter $SP_8$ divides its −0.12 dB input signal into output signals −5.3 dB and −1.5 dB below the input signal, and these output signals are fed respectively to the first input terminals of the ninth splitter $SP_9$ and the second SD generator $H_2$.

The fourth splitter $SP_4$ divides its −5.42 dB input signal into output signals −1.68 dB and −4.94 dB below its input signal: of these the −1.68 dB output signal is fed via a line L4 to a fixed phase shifter PE4 and thence to an antenna element E4 of a twelve element antenna array E. There is one such line Ln for each fixed phase shifter/antenna element combination PEn/En (n=1 to 12): connection of the line Ln to the fixed phase shifter PEn is not shown explicitly to avoid too many overlapping lines, but is indicated by "PEn" at the end of the line Ln in each case. The −4.94 dB output signal from the fourth splitter $SP_4$ is fed to the second input terminal of the second SD generator $H_2$.

The ninth splitter $SP_9$ divides its input signal into output signals −1.68 dB and −4.94 dB below its input signal: of these the −1.68 dB output signal is fed via a line L9 to an antenna element E9 via a fixed phase shifter PE9. The 4.94 dB output signal is fed to the second input terminal of the first SD generator $H_1$.

The sixth splitter $SP_6$ is an equal splitter which produces two output signals each 3 dB below its input signal: of these output signals one is fed to the first input terminal of the fifth SD generator $H_5$, and the other is fed to the first input terminal of the third SD generator $H_3$. The seventh splitter $SP_7$ is also an equal splitter producing two output signals each 3 dB below its input signal, and the output signals are fed to the first input terminals of the fourth and sixth SD generators $H_4$ and $H_6$ respectively. The first SD generator $H_1$ has a sum output S connected to the second input terminal of the fourth SD generator $H_4$. It has a difference output D connected to an input terminal of the tenth splitter $SP_{10}$. Similarly, the second SD generator $H_2$ has a sum output S connected to the second input terminal of the fifth SD generator $H_5$. It has a difference output D connected to an input terminal of the eleventh splitter $SP_{11}$.

The tenth splitter $SP_{10}$ is an equal splitter producing two equal output signals each 3 dB below its input signal from the first SD generator $H_1$. One of these output signals is fed via a line L2 to an antenna element E2 via a fixed phase shifter PE2. The other of these output signals is fed to the second input terminal of the third SD generator $H_3$. Similarly, the eleventh splitter $SP_{11}$ is also an equal splitter producing two equal output signals each 3 dB below its input signal from the second SD generator $H_2$. One of these output signals is fed via a line L11 to an antenna element E11 via a fixed phase shifter PE11 and the other is fed to the second input terminal of the sixth SD generator $H_6$.

The third to sixth SD generators $H_3$ to $H_6$ have sum and difference outputs S and D providing drive signals to antenna elements E1, E3, E5 to E8, E10 and E12 via lines L1, L3, L5 to L8, L11 and L12 and fixed phase shifters PE1, PE3, PE5 to PE8, PE10 and PE12 respectively. Direct comparison of the power of the input signal Vin to powers of signals received by antenna elements can be made by adding the dB values marked by each signal path (ignoring losses in non-ideal components): e.g. antenna element E4 receives a signal which has been reduced compared to input power to −3 dB, −0.12 dB, −5.3 dB and −1.68 dB at splitters $SP_1$, $SP_3$, $SP_5$ and $SP_4$, respectively, a total of −9.1 dB. Relative phasing of antenna element drive signals will not be described as the analysis is equivalent mutatis mutandis to those given for earlier embodiments.

The embodiments of the invention described above use 180 degree hybrids. They may be replaced by e.g. 90 degree 'quadrature' hybrids with the addition of 90 degree phase shifters to obtain the same overall functionality, but this is less practical.

Examples of the invention have been described based on a sequential connection of splitters and hybrids, abbreviated to (S-H). From these, further examples of the invention can be conceived with more stages, e.g. S-H-S, S-H-S-H, etc.

The invention claimed is:

1. A phased array antenna system with adjustable electrical tilt and having an array of antenna elements, the system incorporating:

a) a first splitting apparatus for splitting a primary signal into first and second signals, b) a variable phase shifter for introducing a variable relative phase shift between the first and second signals, c) a second splitting apparatus for dividing the relatively phase shifted first and second signals into respective component signals, and d) a signal combining network for forming vectorial combinations of the component signals, the second splitting apparatus and the signal combining network being in combination a means for providing drive signals for individual antenna elements, the drive signals consisting at least partly of the said vectorial combinations and varying in phase progressively across the array as a function of antenna element position as required for phased array operation and such that the angle of electrical tilt of the array is adjustable in response to alteration of the variable relative phase shift introduced by the variable phase shifter.

2. A system according to claim 1 having an odd number of antenna elements.

3. A system according to claim 1 wherein the variable phase shifter is a first variable phase shifter and the system includes a second variable phase shifter arranged to phase shift a component signal which has been phase shifted by the first variable phase shifter, the second variable phase shifter providing a further component signal output for the signal combining network either directly or via one or more splitter/variable phase shifter combinations.

4. A system according to claim 1 wherein the variable phase shifter is a one of a plurality of variable phase shifters, and the signal combining network is arranged to produce antenna element drive signals from component signals some of which have passed through all the variable phase shifters and some of which have not.

5. A system according to claim 1 wherein the second splitting apparatus is arranged to divide a component signal into further component signals for input to the signal combining network.

6. A system according to claim 1 wherein the signal combining network employs phase shifters and hybrid couplers (hybrids) for phase shifting and forming vectorial combinations.

7. A system according to claim 6 wherein the hybrids are 180 degree hybrids.

8. A system according to claim 6 wherein the hybrids are ring hybrids with circumference $(n+\frac{1}{2})\lambda$ and neighbouring ports separated by $\lambda/4$, where n is an integer and$\lambda$ is a signal wavelength in material of which each ring hybrid is constructed.

9. A system according to claim 8 wherein the splitting apparatus incorporates ring hybrids with circumference $(n+\frac{1}{2})\lambda$ and neighbouring ports separated by $\lambda 4$, one input port of each splitting apparatus hybrid being terminated with a resistor equal to the system impedance and forming a matched load.

10. A system according to claim 1 wherein the second splitting apparatus, variable phase shifter, and the signal combining network are co-located with the antenna element array as an antenna assembly, and the assembly has a single input power feeder for feeding the primary signal to the first splitting apparatus from a remote source.

11. A system according to claim 1 wherein the second splitting apparatus incorporates first and second splitters, the first splitting apparatus is located with the variable phase shifter remotely from the second splitting apparatus, the second splitting apparatus, the signal combining network and the antenna array are co-located as an antenna assembly, and the assembly has dual input power feeders for feeding the first and second signals to the antenna assembly from a remote source at which the first splitting apparatus and variable phase shifter are located.

12. A system according to claim 1 wherein the variable phase shifter is a first variable phase shifter connected in a transmit channel, and the system includes a second variable phase shifter connected in a receive channel and further transmit and receive channels providing fixed phase shifts, and the signal combining network is arranged to operate in both transmit and receive modes by producing antenna element drive signals in response to signals in the transmit channels and producing receive channel signals from signals developed by antenna elements operating in receive mode, the system having independently adjustable electrical tilt in both transmit and receive modes.

13. A system according to claim 1 wherein the variable phase shifter is one of a plurality of variable phase shifters associated with respective operators, and the system includes filtering and combining apparatus for routing signals on to common signal feed apparatus after phase shifting in respective variable phase shifters, the common signal feed apparatus being connected to the second splitting apparatus and a the signal combining network for providing signals to the antenna array containing contributions from both operators with independently adjustable electrical tilt.

14. A system according to claim 13 wherein the plurality of variable phase shifters comprises a respective pair of variable phase shifters associated with each operator, and the system has components to which have both forward and reverse signal processing capabilities such that the system is operative in transmit and receive modes with independently adjustable electrical tilt in each mode.

15. A method of adjusting the electrical tilt of a phased array antenna system, the system including an array of antenna elements, the method comprising the steps of:

a) splitting a primary signal into first and second signals, b) introducing a variable relative phase shift between the first and second signals, c) dividing the relatively phase shifted first and second signals into respective component signals, and d) forming vectorial combinations of component signals to provide respective drive signals for individual antenna elements, the drive signals consisting at least partly of the said vectorial combinations and varying in phase progressively across the array as a function of antenna element position as required for phased array operation and such that the angle of electrical tilt of the array is adjustable in response to alteration of the variable relative phase shift.

16. A method according to claim 15 wherein the array has an odd number of antenna elements.

17. A method according to claim 15 including the step of generating at least one component signal having a phase shift applied collectively by a plurality of variable phase shifters.

18. A method according to claim 17 wherein the variable phase shifters are ganged, and the method includes producing antenna element drive signals from component signals some of which have a phase shift applied collectively by all the variable phase shifters, and some of which have not.

19. A method according to claim 15 including the step of dividing a component signal into further component signals for forming additional vectorial combinations to provide more antenna element drive signals.

20. A method according to claim 15 employing phase shifters and hybrids for phase shifting and forming vectorial combinations of the component signals.

21. A method according to claim 20 wherein the hybrids are 180 degree hybrids.

22. A method according to claim 20 wherein the hybrids are ring hybrids with circumference $(n+\frac{1}{2})\lambda$ and neighbouring input and output ports separated by $\lambda/4$where n is an integer and $\lambda$ is a signal wavelength in material of which each ring hybrid is constructed.

23. A method according to claim 15 including the step of feeding the primary signal as a single input signal from a remote source for splitting, variable phase shifting and forming vectorial combinations in a network co-located with the antenna array and forming therewith an antenna assembly.

24. A method according to claim 15 including the step of feeding the first and second signals with variable phase relative to one another from a remote source to an antenna assembly for splitting and forming vectorial combinations in a network co-located with the antenna array.

25. A method according to claim 15 employing transmit and receive channels for operation in both transmit and receive modes, and including producing antenna element drive signals in response to transmit channel signals and producing receive channel signals from signals developed by antenna elements operating in receive mode with independently adjustable electrical tilt in both transmit and receive modes.

26. A method according to claim 15 wherein the variable phase shift is one of a plurality of variable phase shifts, the first and second signals are a signal pair, the pair is one of a plurality of pairs of relatively phase shifted signals, and each variable phase shift and pair is associated with a respective operator, and the method includes:

a) filtering and combining signals and passing them to common signal feed apparatus after phase shifting in respective variable phase shifters for implementation of the steps of dividing and forming vectorial combinations;

b) providing signals to the array containing contributions from each operator; and c) adjusting electrical tilt associated with each operator independently.

27. A method according to claim 26 wherein the plurality of variable phase shifts is implemented by a respective pair of variable phase shifters associated with each operator, the method employs components which have both forward and reverse signal processing capabilities, and the method includes operating in transmit and receive modes with independently adjustable electrical tilt in both modes.

28. A system according to claim 6 wherein the hybrids are designed to convert input signals I1 and I2 into vector sums and differences other than (I1+I2) and (I1 −I2).

29. A method according to claim 20 wherein the hybrids are designed to convert input signals I1 and I2 into vector sums and differences other than (I1+I2) and (I1−I2).

30. A method according to claim 20 wherein the step of dividing the relatively phase shifted first and second signals into component signals employs ring hybrids each having:

d) circumference $(n+\frac{1}{2})\lambda$ e) neighbouring ports separated by $\lambda/4$, and f) an input port terminated with a resistor equal to the system impedance and forming a matched load where n is an integer and $\lambda$ is a signal wavelength material of which each ring hybrid is constructed.

* * * * *